US007246715B2

(12) United States Patent
Smith et al.

(10) Patent No.: US 7,246,715 B2
(45) **Date of Patent: *Jul. 24, 2007**

(54) RECLOSABLE CONTAINER LID

(75) Inventors: Stephen Alan Smith, Naperville, IL (US); Dawn Ellen Huston, Lindenhurst, IL (US); Warren Giles Wiedmeyer, Trevor, WI (US); Stephen William Sullivan, Round Lake Beach, IL (US); Rich Matthew Chin, Lincolnwood, IL (US); Mohammed Maqsood Ahmed, Niles, IL (US); John Stewart Gitschlag, Chicago, IL (US); David Raymond Langelan, Oak Park, IL (US); Rajendra Ranjitbhai Chauhan, Skokie, IL (US); William Edward Hurst, Lisle, IL (US); James Tam Joines, Jr., Gurnee, IL (US); Kevin Ray Smith, Round Lake Beach, IL (US); Mark Gerald Anhalt, Franklin, WI (US); Bryce G. Rutter, St. Louis, MO (US); Brian C. Bone, St. Louis, MO (US); Heath A. Doty, Richmond Heights, MO (US); Richard Michael Sandusky, Palatine, IL (US)

(73) Assignee: Solo Cup Operating Corporation, Highland Park, IL (US)

( * ) Notice: Subject to any disclaimer, the term of this patent is extended or adjusted under 35 U.S.C. 154(b) by 332 days.

This patent is subject to a terminal disclaimer.

(21) Appl. No.: 10/622,374

(22) Filed: Jul. 18, 2003

(65) Prior Publication Data
US 2004/0089662 A1 May 13, 2004

Related U.S. Application Data

(63) Continuation-in-part of application No. 09/923,763, filed on Aug. 6, 2001, now Pat. No. 6,732,875.

(51) Int. Cl.

| | |
|---|---|
| ***B65D 51/18*** | (2006.01) |
| ***B65D 41/18*** | (2006.01) |
| ***A47G 19/22*** | (2006.01) |
| ***B23P 11/00*** | (2006.01) |

(52) U.S. Cl. ..... 220/253; 220/793; 220/256.1; 220/715; 29/434; 29/453

(58) Field of Classification Search ..... 220/253, 220/259.1, 256.1, 731, 713–719, 254.4, 254.1, 220/254.3, 254.7–254.9, 805, 793, 255; 229/404, 229/906.1; 222/548, 555, 480, 516; 29/434, 29/453

See application file for complete search history.

(56) References Cited

U.S. PATENT DOCUMENTS 1,157,537 A * 10/1915 Hess ..... 222/511

(Continued)

FOREIGN PATENT DOCUMENTS

CH 393 955 11/1965

(Continued)

OTHER PUBLICATIONS

Photograph of HotJo Ceramic Mug/Lid obtained through market research, Apr. 2000.

(Continued)

*Primary Examiner*—Robin Hylton

(57) ABSTRACT

A reclosable lid 310 for a container holding a flowable substance has a cover 312 and a rotatable element 50 rotatably supported by the cover 312. The cover 312 has an opening 28 and a slot 30 located in a top wall 14 of the cover 312. The cover 312 also has a tab 323 extending outward from a portion of the cover 312. The rotatable element 50 has at least one aperture 78 and an actuator 54 that is accessible through the slot 30. The element 50 is moveable by manipulation of the actuator 54 between a first position wherein the aperture 78 is misaligned with the opening 28, and a second position wherein the aperture 78 is aligned with the opening 28. The cover 312 has at least one support member 102 extending radially inward from an inner surface 100 of the cover 312, wherein the support member 102 rotatably supports the element 50.

28 Claims, 14 Drawing Sheets

U.S. PATENT DOCUMENTS

| | | | | |
|---|---|---|---|---|
| 1,237,228 | A | | 8/1917 | Westover |
| 1,725,393 | A | | 8/1929 | Cone |
| 1,752,720 | A | | 4/1930 | Bergelson |
| 1,896,976 | A | | 2/1933 | Schifferdecker |
| 2,121,554 | A | | 6/1938 | Thorn |
| 2,495,806 | A | | 1/1950 | Block |
| 2,554,710 | A | | 5/1951 | Leccese |
| 3,031,111 | A | | 4/1962 | Stull |
| 3,083,861 | A | | 4/1963 | Amberg et al. |
| 3,188,036 | A | | 6/1965 | Sprung |
| 3,193,130 | A | | 7/1965 | Miller |
| 3,261,516 | A | * | 7/1966 | Allen ..... 222/548 |
| 3,262,612 | A | | 7/1966 | Tabor |
| 3,326,401 | A | | 6/1967 | De Long |
| 3,327,905 | A | | 6/1967 | Gould |
| 3,459,324 | A | | 8/1969 | Miller |
| 3,690,514 | A | | 9/1972 | Wilson |
| 3,805,991 | A | | 4/1974 | Cheladze et al. |
| 3,874,580 | A | | 4/1975 | Weatherhead III |
| 3,994,411 | A | | 11/1976 | Elfelt et al. |
| 4,091,956 | A | | 5/1978 | Vecchio |
| 4,138,033 | A | | 2/1979 | Payne et al. |
| 4,141,461 | A | | 2/1979 | LaChance |
| 4,183,443 | A | | 1/1980 | DeParales et al. |
| 4,188,457 | A | | 2/1980 | Throp |
| 4,203,527 | A | * | 5/1980 | LaChance, Sr. ..... 220/253 |
| 4,253,582 | A | | 3/1981 | Shields |
| 4,331,255 | A | | 5/1982 | Fournier |
| 4,333,583 | A | | 6/1982 | Montemarano |
| 4,345,695 | A | | 8/1982 | Galloway et al. |
| 4,347,946 | A | | 9/1982 | Nichols |
| 4,350,260 | A | | 9/1982 | Prueher |
| 4,361,249 | A | | 11/1982 | Tuneski et al. |
| 4,420,092 | A | | 12/1983 | Finkelstein |
| 4,441,624 | A | | 4/1984 | Sokolowski |
| 4,449,640 | A | | 5/1984 | Finkelstein |
| 4,460,103 | A | | 7/1984 | Rama et al. |
| 4,478,346 | A | | 10/1984 | Spong |
| 4,503,992 | A | | 3/1985 | Sitko et al. |
| 4,557,398 | A | | 12/1985 | Hambleton et al. |
| 4,570,817 | A | | 2/1986 | Hambleton et al. |
| 4,579,245 | A | | 4/1986 | Narushko |
| 4,589,569 | A | | 5/1986 | Clements |
| 4,598,837 | A | | 7/1986 | Kreiseder et al. |
| 4,615,459 | A | | 10/1986 | Clements |
| 4,619,372 | A | | 10/1986 | McFarland |
| 4,629,088 | A | | 12/1986 | Durgin |
| 4,657,139 | A | | 4/1987 | Hanifl |
| 4,703,873 | A | | 11/1987 | Geren |
| 4,705,197 | A | | 11/1987 | Gordon et al. |
| 4,718,570 | A | | 1/1988 | Diener |
| 4,738,373 | A | | 4/1988 | DeParales |
| 4,741,450 | A | | 5/1988 | Braude |
| 4,747,511 | A | | 5/1988 | Dutt et al. |
| 4,753,365 | A | | 6/1988 | Seppala |
| 4,770,325 | A | | 9/1988 | Gordon et al. |
| 4,782,975 | A | | 11/1988 | Coy |
| 4,790,444 | A | | 12/1988 | Terzi |
| 4,792,054 | A | | 12/1988 | Weidman |
| 4,796,774 | A | | 1/1989 | Nabinger |
| 4,863,051 | A | | 9/1989 | Eibner et al. |
| 4,869,389 | A | | 9/1989 | Cerrone, Jr. |
| 4,874,103 | A | | 10/1989 | Quisenberry et al. |
| 4,898,295 | A | | 2/1990 | Kim |
| 4,899,902 | A | | 2/1990 | DeMars |
| 4,915,250 | A | | 4/1990 | Hayes |
| 4,930,654 | A | | 6/1990 | Thibeault et al. |
| 4,932,555 | A | | 6/1990 | La Barge |
| 4,938,379 | A | | 7/1990 | Kellner |
| 4,949,865 | A | | 8/1990 | Turner |
| 4,953,743 | A | | 9/1990 | Dart et al. |
| 4,966,300 | A | | 10/1990 | Coonradt |
| 5,012,061 | A | | 4/1991 | Lesser |
| 5,090,584 | A | | 2/1992 | Roberts et al. |
| 5,111,961 | A | | 5/1992 | Van Melle |
| 5,143,248 | A | * | 9/1992 | Sawatsky ..... 220/711 |
| 5,148,936 | A | | 9/1992 | DeGrow |
| 5,167,338 | A | | 12/1992 | Kick |
| 5,180,073 | A | | 1/1993 | Fay et al. |
| 5,183,172 | A | | 2/1993 | Boller |
| 5,193,704 | A | | 3/1993 | Kick |
| 5,197,624 | A | | 3/1993 | Doddaro |
| 5,205,430 | A | | 4/1993 | Valyi |
| 5,294,014 | A | | 3/1994 | Wyatt et al. |
| D346,718 | S | | 5/1994 | Timmermans |
| 5,317,796 | A | * | 6/1994 | Hunter ..... 29/434 |
| 5,348,181 | A | * | 9/1994 | Smith et al. ..... 220/254.3 |
| 5,395,006 | A | | 3/1995 | Verma |
| 5,398,843 | A | | 3/1995 | Warden et al. |
| 5,415,312 | A | | 5/1995 | Mueller |
| 5,421,472 | A | | 6/1995 | Beckertgis |
| 5,449,085 | A | | 9/1995 | Brun, Jr. |
| 5,485,938 | A | | 1/1996 | Boersma |
| 5,490,609 | A | | 2/1996 | Lane et al. |
| 5,495,941 | A | | 3/1996 | Leonard |
| 5,497,920 | A | | 3/1996 | Moeller et al. |
| D368,624 | S | | 4/1996 | Forrer |
| 5,503,289 | A | | 4/1996 | Fox |
| 5,503,662 | A | | 4/1996 | Berger |
| 5,588,561 | A | | 12/1996 | Ness |
| 5,613,619 | A | * | 3/1997 | Van Melle ..... 220/712 |
| 5,699,927 | A | | 12/1997 | Lane et al. |
| 5,706,972 | A | | 1/1998 | Sousa |
| 5,718,353 | A | | 2/1998 | Kanfer et al. |
| 5,727,707 | A | | 3/1998 | Wickland et al. |
| 5,766,660 | A | | 6/1998 | Lee et al. |
| 5,775,205 | A | | 7/1998 | Melton |
| 5,839,601 | A | | 11/1998 | Van Melle |
| D402,556 | S | | 12/1998 | Frye |
| 5,866,184 | A | | 2/1999 | Gorlich et al. |
| 5,873,298 | A | | 2/1999 | Chang |
| 5,911,331 | A | | 6/1999 | Boller |
| 5,913,964 | A | | 6/1999 | Melton |
| 5,947,319 | A | | 9/1999 | Sinski |
| 5,947,323 | A | | 9/1999 | Freek et al. |
| 5,954,241 | A | | 9/1999 | Huang |
| 5,979,689 | A | | 11/1999 | Lansky |
| 5,984,127 | A | | 11/1999 | Fenton |
| 5,996,837 | A | | 12/1999 | Freek et al. |
| 6,003,711 | A | | 12/1999 | Bilewitz |
| 6,010,029 | A | | 1/2000 | Wang |
| 6,089,397 | A | | 7/2000 | Van Melle |
| 6,095,033 | A | | 8/2000 | Melton |
| 6,176,384 | B1 | | 1/2001 | Voloshin |
| D437,223 | S | | 2/2001 | Coy et al. |
| 6,199,711 | B1 | | 3/2001 | Lansky |
| 6,216,904 | B1 | | 4/2001 | Cagan |
| 6,220,470 | B1 | | 4/2001 | McHenry et al. |
| 6,305,571 | B1 | | 10/2001 | Chu |
| 6,374,726 | B1 | | 4/2002 | Melton |
| 6,419,105 | B1 | | 7/2002 | Bruce et al. |
| 6,578,726 | B1 | | 6/2003 | Schaefer |
| 6,612,456 | B1 | | 9/2003 | Hundley et al. |
| D480,968 | S | | 10/2003 | Atkins et al. |
| 6,644,490 | B2 | | 11/2003 | Clarke |
| 6,732,875 | B2 | * | 5/2004 | Smith et al. ..... 220/253 |
| 2002/0027139 | A1 | | 3/2002 | O'Neill |
| 2003/0089713 | A1 | | 5/2003 | Belt et al. |
| 2003/0089714 | A1 | | 5/2003 | Dart et al. |
| 2003/0141302 | A1 | | 7/2003 | Ryan et al. |
| 2003/0197012 | A1 | * | 10/2003 | Smith et al. ..... 220/253 |
| 2005/0127075 | A1 | * | 6/2005 | Smith et al. ..... 220/253 |

2006/0000832 A1* 1/2006 Smith et al. ..... 220/253

FOREIGN PATENT DOCUMENTS

| | | | |
|---|---|---|---|
| DE | 18 16 709 | A | 2/1970 |
| DE | 295 02 654 | U1 | 8/1995 |
| EP | 0 160 372 | A | 11/1985 |
| EP | 0 383 442 | A1 | 8/1990 |
| GB | 1 576 126 | A | 10/1980 |
| GB | 1 600 917 | | 10/1981 |
| GB | 2 091 232 | A | 7/1982 |
| GB | 2 182 027 | A | 5/1987 |
| JP | 07-309379 | | 11/1995 |
| JP | 10-129706 | A | 5/1998 |
| JP | 2000-159254 | | 6/2000 |
| WO | WO 99 47429 | | 9/1999 |
| WO | WO 00 51908 | | 9/2000 |

OTHER PUBLICATIONS

Photograph of Starbucks Cup/Lid obtained through market research, Apr. 2000.
Photograph of Super America Cup/Lid obtained through market research, Apr. 2000.
Photograph of Dunkin Donuts Cup/Lid obtained through market research, Apr. 2000.
Berrington, N., *International Search Report*, Sep. 4, 2002, 6 pp., Patent Cooperation Treaty; Rijswijk, Netherlands.
Seven (7) color photographs showing different views of Whirley Thermo Mug/Lid obtained in Feb. 2003.
US 6,003,721, 12/1999, Fleming (withdrawn)

* cited by examiner

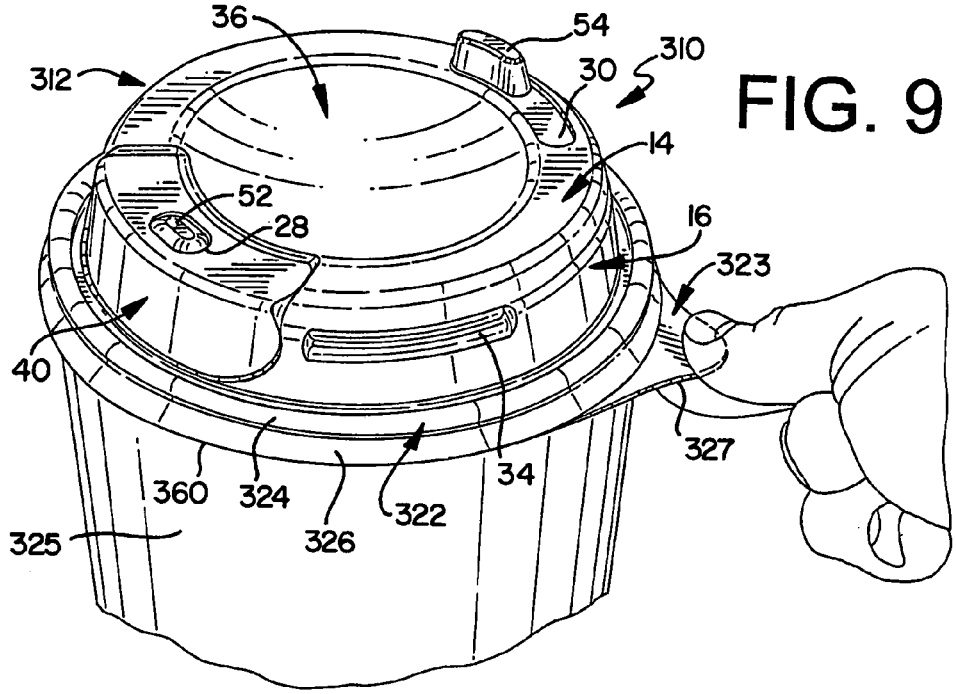
FIG. 9
FIG. 10
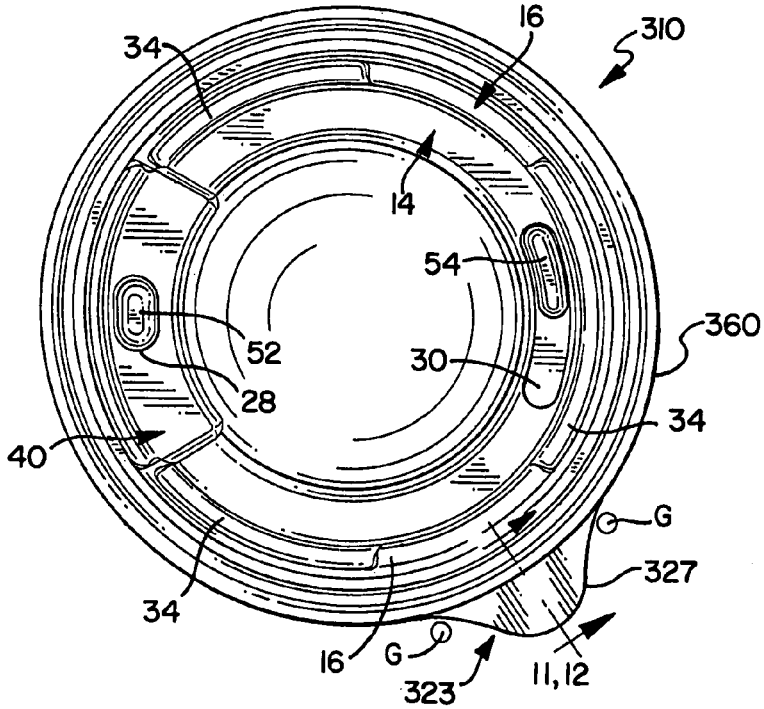

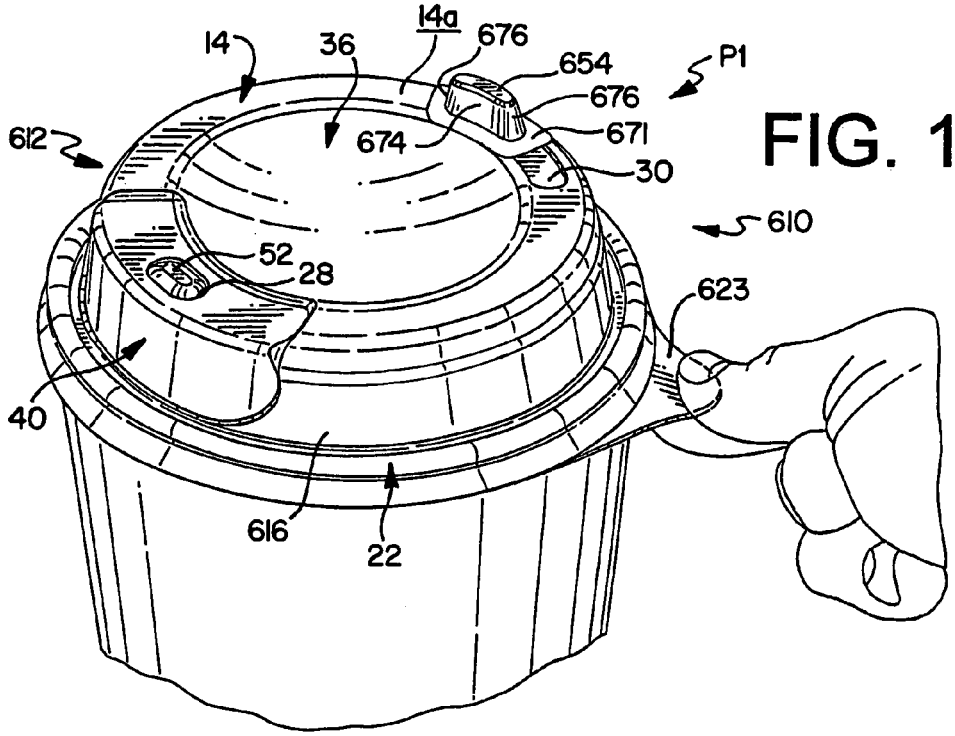
FIG. 17
FIG. 18
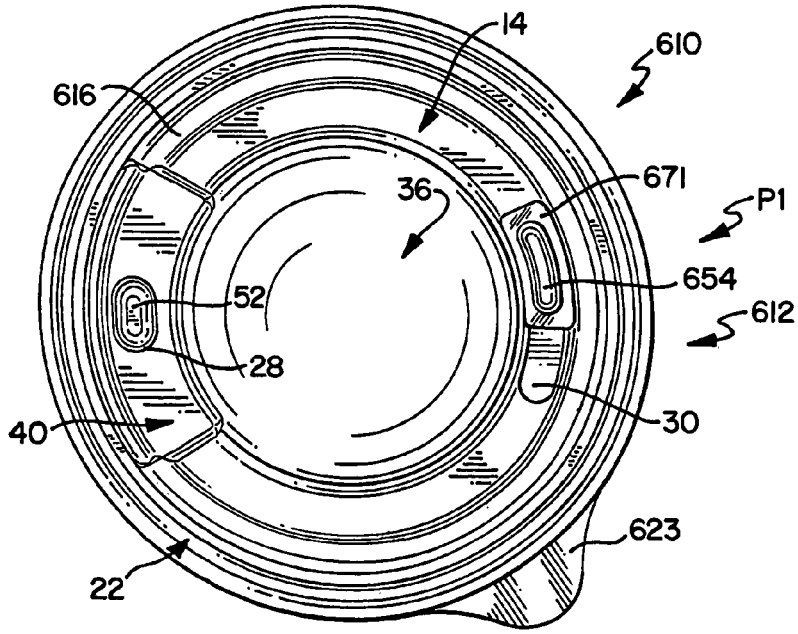

FIG. 21A
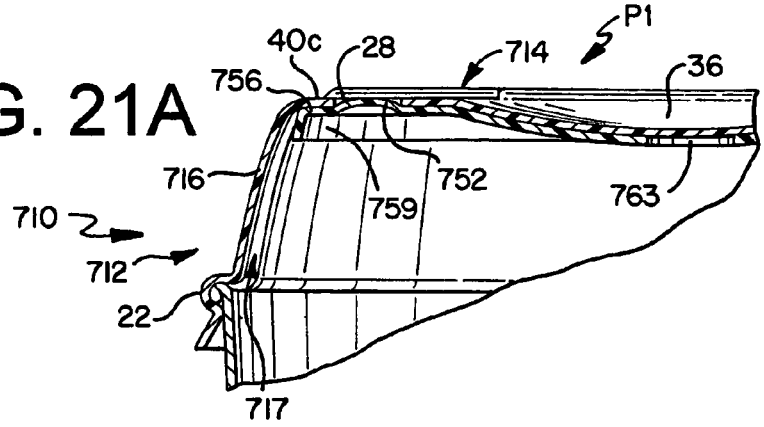
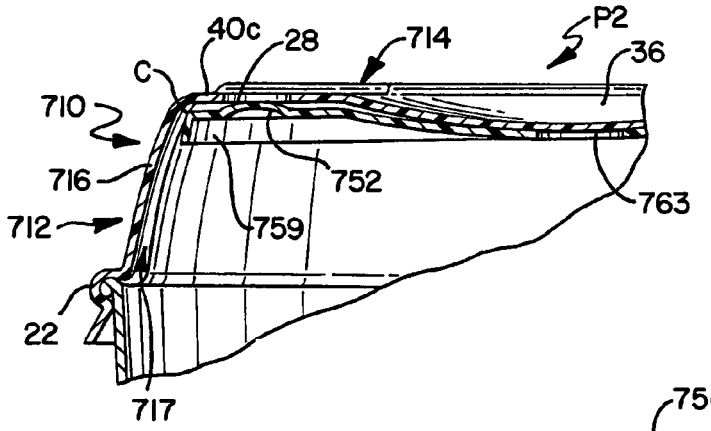
FIG. 21B
FIG. 22
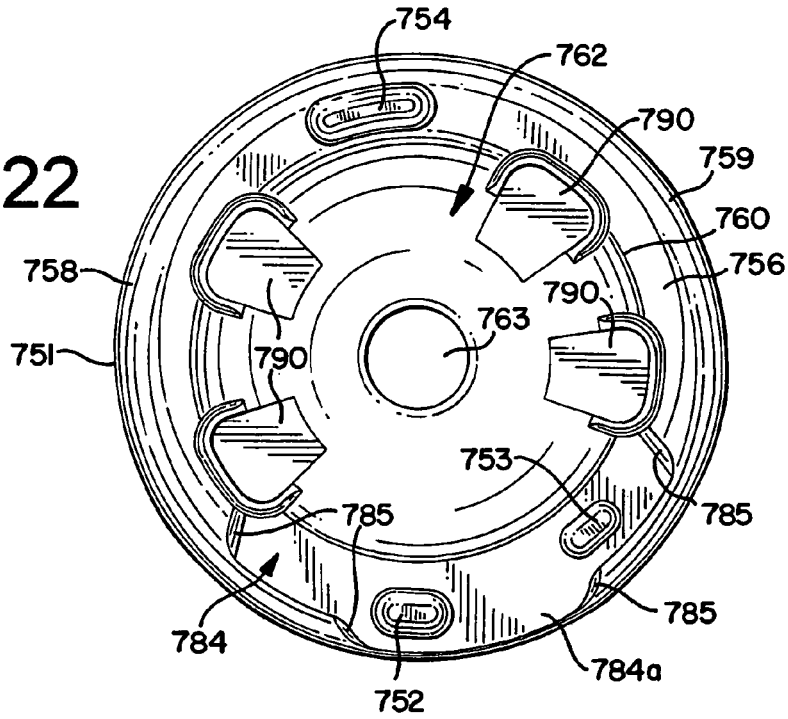

RECLOSABLE CONTAINER LID

CROSS-REFERENCE TO RELATED APPLICATIONS

This is a Continuation-in-Part (CIP) Application from application Ser. No. 09/923,763, (filed on Aug. 6, 2001), now U.S. Pat. No. 6,732,875 which Application is incorporated by reference and made a part hereof.

FEDERALLY SPONSORED RESEARCH OR DEVELOPMENT

Not Applicable.

TECHNICAL FIELD

The present invention relates to a lid for a flowable substance container. More specifically, the present invention relates to a reclosable lid for use with a drink container.

BACKGROUND OF THE INVENTION

Lids for containers are well-known in the beverage container industry. In general terms, lids for single-use or disposable containers have three main components: a top wall or surface, a mounting portion, and an opening. Typically, the mounting portion is adapted to engage an upper rim of the container to seal the lid on the container. The opening is adapted to permit the flow of the container contents through the lid.

Existing lid designs suffer from a number of problems including untimely spillage through the opening due to the lack of a reliable means for sealing the opening. The inability to effectively seal the opening can also result in a significant loss of heat from the container contents through the opening. To address these and other problems, a number of lid designs include a movable cover portion for the opening. However, most existing movable covers lack structural integrity and as a result, do not effectively seal the opening. Also, a number of movable covers are difficult to operate due to their complex design. In addition, a vast majority of movable covers interfere with a user consuming the container contents through the opening.

U.S. Pat. No. 4,579,245 to Narushko provides an example of a container lid with a movable closing flap. The lid has a raised segment that forms a channel, which is adapted to receive the closing flap. The closing flap is a curved piece that must be inserted into the channel. The closing flap is movable between an open position and a closed position. Because the movement of the closing flap is controlled by a series of notches, grooves, tabs and handles located on the channel and the closing flap, the closing flap is difficult to operate and the effectiveness of the lid is compromised.

Another example of a lid having a movable cover for the opening is disclosed in U.S. Pat. No. 4,790,444 to Terzi. There, the hood or lid has an opening formed from a depending spout that is inserted into the container opening. The cover has exterior dimensions equivalent to the lid and is placed over the lid. The cover has an opening that must be aligned with the spout and the lid opening to form the drink passageway. The cover has a plurality of sockets, which when properly aligned, seal the lid opening. The cover is supported on the lid by a series of intricate structures and an annular gasket. Due to its complex array of structures, the lid and cover are difficult to assemble and operate. Furthermore, the array of structures can inhibit the alignment of the lid opening and the cover opening negatively affecting the formation of the drink passageway.

Therefore, there is a definite need for a reclosable container lid that reliably seals the opening. In addition, there is a need for such a lid that is easy to operate and does not interfere with a user consuming the container contents through the opening.

The present invention is provided to solve these and other problems.

SUMMARY OF THE INVENTION

The present invention relates to a reclosable lid for use with a flowable substance container. The lid has a first piece or cover, and a reclosable second piece or disk. The cover has a top wall and a side wall depending from the top wall. The side wall has a mounting portion for connecting the lid on the container. The cover includes an opening in the top wall, the opening adapted to permit the flow of the substance through the lid. The cover further includes a slot located in the top wall and a recessed portion located in both the top wall and the side wall.

The disk has at least one aperture, a post, and a projection. The aperture and the projection are each cooperatively dimensioned with the opening. The aperture is adapted to form a passageway when aligned with the opening. The post is adapted to be received by the slot in the cover. The disk is movable between a first and second position, wherein at least a portion of the projection is received in the opening in the first position and wherein the aperture is aligned with the opening in the second position. The disk has at least one well adapted to facilitate stacking the lids in a vertical configuration.

The cover includes at least one support member having a cavity extending radially inward from the side wall. The cavity of the support member forms a support ledge on an inner surface of the cover that is adapted to provide rotatable support to the disk. The disk is further supported by an internal edge that is formed on the inner surface by the recessed portion, which extends radially inward from the side wall.

The disk is movable between the first and second positions by a user engaging and actuating the post. While the disk is moved between the first and second positions, the disk is rotatably supported by the support ledge and the support edge.

In another preferred embodiment of the invention, the lid includes a cover and an overlay. The cover has a top wall and a side wall depending from the top wall. The side wall has a mounting portion for connecting the lid on the container. The lid includes an opening in the top wall, the opening adapted to permit the flow of the substance through the lid. The lid further includes a recessed portion located in both the top wall and the side wall.

The overlay has a top wall and a side wall depending from the top wall. The side wall has a mounting portion adapted to connect the overlay to the cover. Also, the overlay has a projection in the top wall and at least one aperture. In addition, the overlay has at least one gripping element adapted to facilitate rotational movement of the overlay.

The overlay and the disk are cooperatively dimensioned such that they are in rotational engagement when the overlay is positioned on the disk. The overlay is movable between a first position and a second position, wherein a portion of the projection is received in the opening in the first position and wherein the aperture is aligned with the opening in the overlay in the second position.

The overlay is movable between the first and second positions by a user engaging either the overlay or the gripping element. While the overlay is moved between the first and second positions, the overlay is rotatably supported by the engagement of the mounting portion of the cover and the mounting portion of the overlay.

According to another aspect of the invention, the lid has a tab extending radially outward from a mounting portion of the cover. The tab has a plurality of segments, including at least one sloped or angled segment. Preferably, the tab has curvilinear configuration and is integrally formed with the cover. The tab is adapted to ensure the proper assembly of the lid by fixing the position of the cover with respect to the rotatable element.

Other features and advantages of the invention will be apparent from the following specification taken in conjunction with the following drawings.

BRIEF DESCRIPTION OF THE DRAWINGS

FIG. 9 is a perspective view of an alternate embodiment of a lid of the present invention, showing a tab extending from a cover of the lid;

FIG. 10 is top plan view of the lid of FIG. 9;

FIG. 17 is a perspective view of an alternate embodiment of a lid of the present invention;

FIG. 18 is a top plan view of the lid of FIG. 17;

FIG. 21A is a partial cross-sectional view of the lid of FIG. 19 taken along line 21—21, showing the lid in a closed position;

FIG. 21B is a partial cross-sectional view of the lid of FIG. 19 taken along line 21—21, showing the lid in an open position;

FIG. 22 is top plan view of the lid of FIG. 19, showing the rotatable element;

Figure 1:
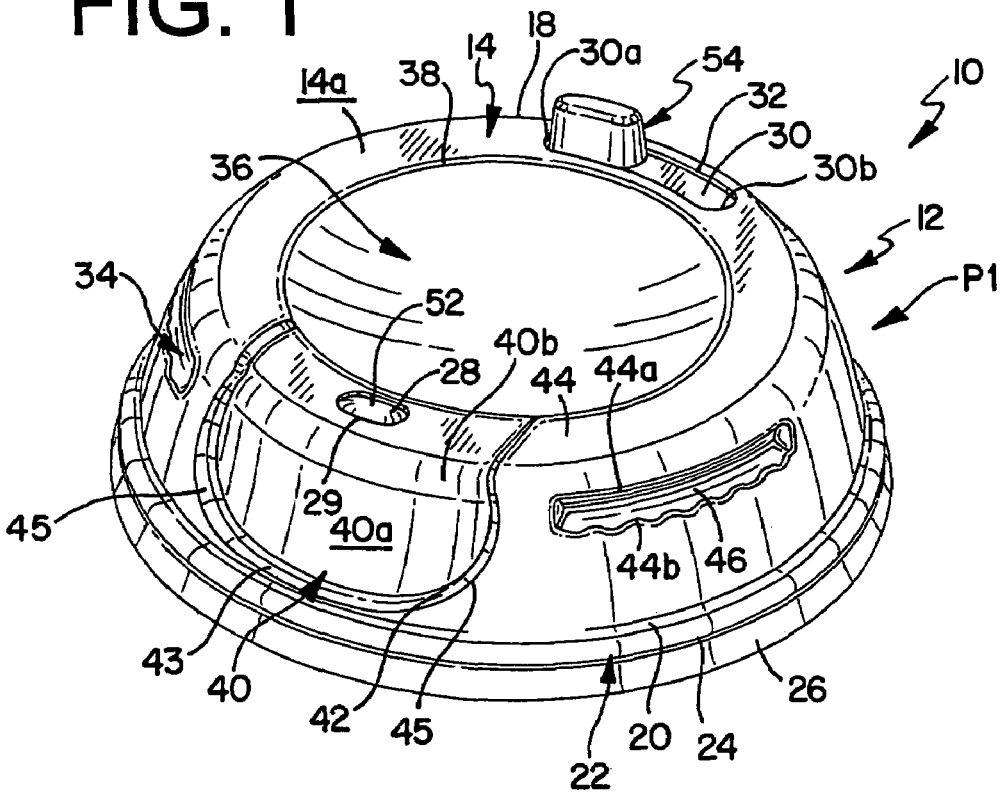
FIG. 1 is a perspective view of a reclosable lid of the present invention, showing a cover.

DETAILED DESCRIPTION OF THE INVENTION:

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

A reclosable lid 10 for a container (not shown) of the present invention is illustrated in FIG. 1. The container has a central opening defining a volume that can be used to hold or contain a flowable substance, for example a liquid or a powder. The container and the lid 10 can be of either the disposable or extended use variety. FIG. 1 shows the lid 10 in the closed position wherein the lid 10 is sealed such that the flowable substance cannot flow through the lid 10. The lid 10 generally has a first piece or cover 12, and a movable second piece or disk 50 (positioned underneath cover 12 in FIG. 1).

The cover 12 of the lid 10 is adapted to span the opening in the upper portion of the container that is generally defined by an upper rim or edge of the container. For illustrative purposes, the container could be a coffee cup having an opening defined by the rim of the cup.

The cover 12 has an annular top wall 14 and a side wall 16 depending from a peripheral edge 18 of the top wall 14. Although the top wall 14 is shown as having a generally flat upper surface 14*a*, the upper surface 14*a* can be curved or angled. The side wall 16 has a side wall surface 16*a* and a lower edge 20. The side wall surface 16*a* can be curved or generally flat. The overall shape of the cover 12 is generally frustaconical, however, the cover 12 can have a number of other configurations.

A mounting portion 22 depends from the lower edge 20 of the side wall 16. The mounting portion 22 includes a generally annular flange 24 and a generally annular skirt 26. The mounting portion 22 is adapted for connecting the lid 10 to the container in a manner that seals the lid 10 on the container. Thus, the mounting portion 22 prevents leakage of the container contents between the lid 10 and the container when the lid 10 is positioned on the container. In a preferred embodiment, the mounting portion 22 is integral with the side wall 16.

An aperture or drink opening 28 is located preferably in the top wall 14. Alternatively, the drink opening is located in the side wall 16. The opening 28 is adapted to permit the passage or flow of the flowable contents held by the container through the cover 12. The opening 28 has an edge 29 that defines the shape of the opening 28. Although shown in FIG. 1 as having an obround shape, the opening 28 can have a variety of shapes, including but not limited to circular, square, or rectangular. In the closed lid position shown in FIG. 1, at least a portion of a projection 52 of the disk 50 is received by or positioned in the opening 28. Alternatively, the disk 50 has a generally planar surface that is aligned with a surface of the cover 12 proximate the opening 28 in a surface-to-surface engagement such that the opening 28 is sealed. These aspects will be described below in greater detail.

A slot or channel 30 is located preferably in the top wall 14. The slot 30 has an edge 32 that defines the shape of the slot 30. Although shown in FIG. 1 as having an obround shape, the slot 30 can have a variety of shapes, including but not limited to circular, square, or rectangular. A post 54 extends from the movable disk 50. The slot 30 is adapted to receive at least a portion of the post 54 extending through at least a portion of the slot 30. Described in a different manner, at least a portion of the post 54 extends past the top wall surface 14*a*. This aspect will also be described below in greater detail.

Figure 2:
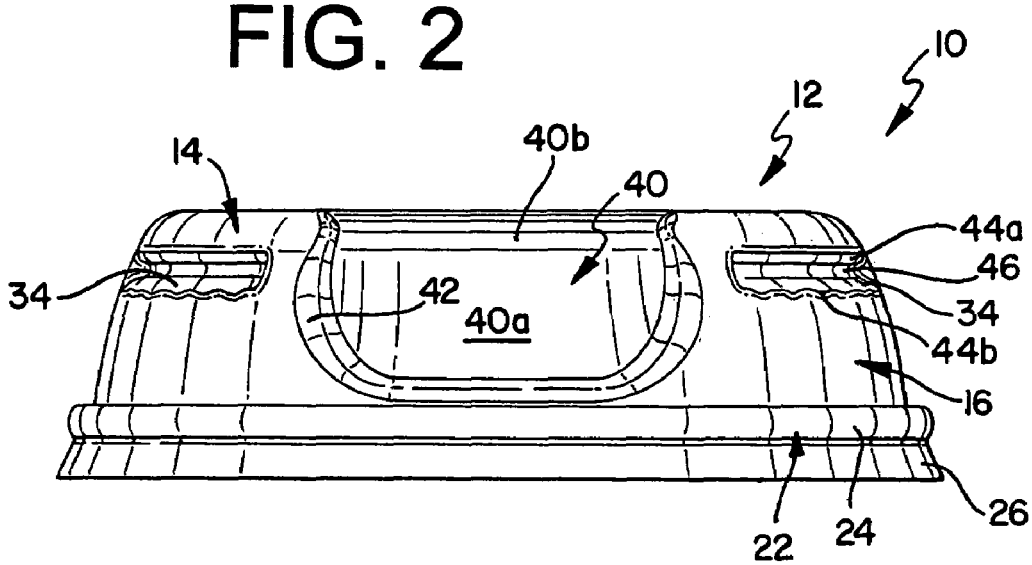
FIG. 2 is an end view of the cover of FIG. 1.

Referring to FIGS. 1 and 2, the cover 12 further comprises at least one support member 34. The support member 34 has a peripheral edge 44 that defines the shape of the support member 34. The peripheral edge 44 has an upper edge 44*a* and a lower edge 44*b*. The peripheral edge 44 can have a variety of shapes, including the linear shape of the upper edge 44*a* and the serrated shape of the lower edge 44*b*. A cavity 46 is recessed from the peripheral edge 44. Described in a different manner, the cavity 46 extends radially inward from the peripheral edge 44. As a result, at least a portion of the support member 34 extends radially inward past an inner surface of the side wall 16. The dimensions and configurations of the support member 34 and the cavity 46 can vary with design parameters, including but not limited to the overall size of the cover 12 and/or the size of the movable second piece 50. The position of the support member 34 can also vary along the height of the side wall 16. For example, the support member 34 can be positioned proximate the peripheral edge 18, or the support member 34 can be positioned closer to the mounting portion 22.

Figure 3:
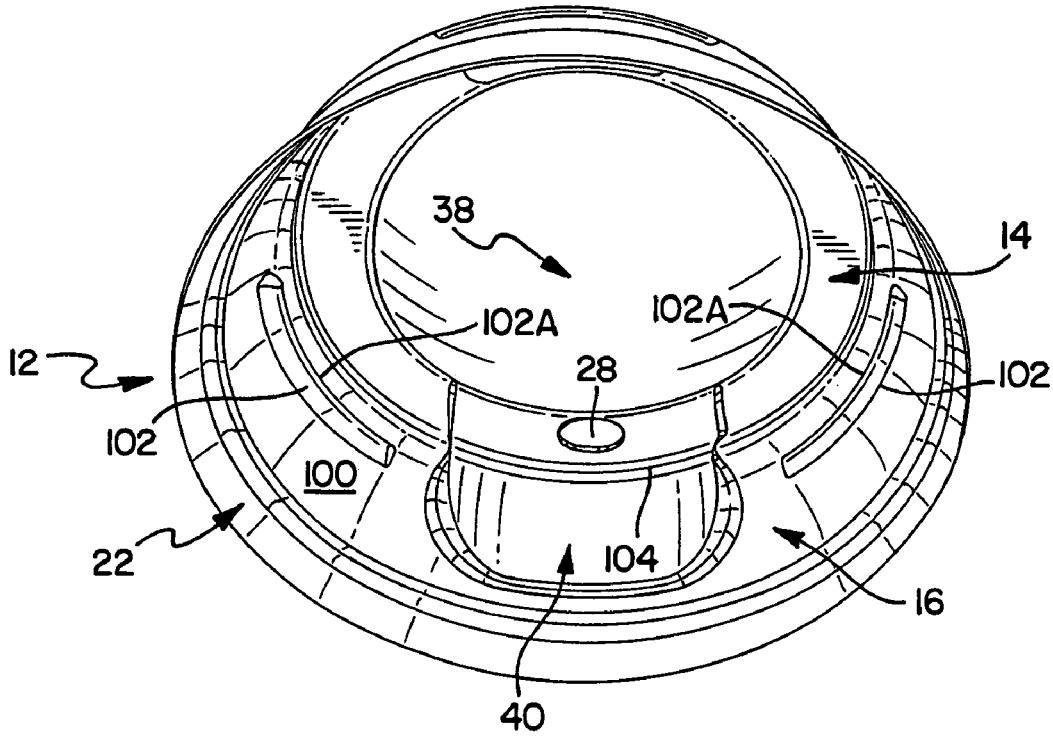
FIG. 3 is a perspective view of an interior cavity of the cover of FIG. 1.

FIG. 3 shows an interior cavity of the lid 12. At least one internal support ledge 102 is positioned on an internal surface 100 of the cover 12. The support ledge 102 is formed from the material defining the cavity 46 of the support member 34 which extends radially inward from the side wall 16. Accordingly, the material that forms the cavity 46 also forms the internal support ledge 102. The support ledge 102 has an upper edge 102*a*. Although shown having an elongated configuration, the dimensions and configurations of the support ledge 102 can vary depending upon the configuration of the support member 34 and the degree to which the support member 34 extends radially inward. The role of the support ledge 102 is fully described below.

As shown in FIG. 1, a center portion 36 is positioned radially inward from an inner edge 38 of the top wall 14. Preferably, the center portion 36 is recessed such that the center portion 36 has a curvilinear configuration when viewed in cross-section. The degree of recess or curvature of the center portion 36 can vary with the design parameters of the lid 10. Alternatively, the center portion 36 is in planar alignment with the top wall 14. In this configuration, the center portion 36 is not recessed.

Referring to FIGS. 1 and 2, the side wall 16 has a recessed portion 40, that is adapted to receive a lip of a person drinking from the container. An edge 42 of recessed portion 40 defines the configuration of the portion 40. In a preferred embodiment, the edge 42 has a generally straight base portion 43 that connects with a generally outwardly curved end segment 45 at each end. The recessed portion 40 is positioned radially inward from the side wall surface 16*a*. Although the recessed portion 40 is shown positioned on both the top wall 14 and the side wall 16, the recessed portion 40 can be limited to either the top wall 14 or the side wall 16. The shape and configuration of the recessed portion 40 can be varied to conform to numerous design parameters. Similarly, the degree of recess of the portion 40 can vary. For example, as shown in FIG. 1, the recessed portion 40 is deeper at base portion 43 and shallower at an end proximate the drink opening 28. Preferably, the recessed portion 40 is positioned about the drink opening 28. The top wall 14 and the side wall 16 cooperate to form a rounded edge 40*b* at the recessed portion 40.

Referring to FIG. 3, an internal support edge 104 is positioned in the internal surface 100 of the cover 12. The internal support edge 104 is formed from the material defining the recessed portion 40 which extends radially inward from the side wall 16. Accordingly, a portion of the material that forms the recessed portion 40 also forms the internal support edge 104. Preferably, the support edge 104 is positioned internal to and coincident with the rounded edge 40*b* of the recessed portion 40. The dimensions and configurations of the support edge 104 can vary depending upon the configuration of the recessed portion 40 and the degree to which the recessed portion 40 extends radially inward. The role of the support edge 104 is fully described below.

Figure 4:
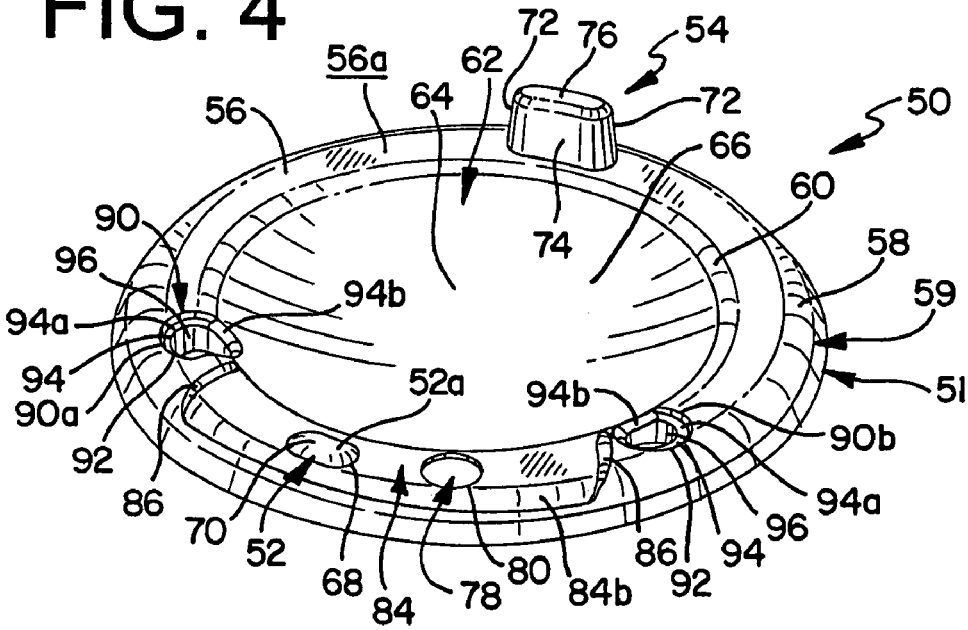
FIG. 4 is a perspective view of a movable disk of the lid of FIG. 1.

FIG. 4 shows the second piece or disk 50. The disk 50 has an outer edge 51 and a top wall 56 with a top wall surface 56*a*. The top wall 56 has an outer shoulder 58 and an inner shoulder 60. A side wall 59 depends from the outer shoulder 58. A center portion 62 extends radially inward from the inner shoulder 60. The center portion 62 comprises an annular side wall 64 and an inner portion 66. Preferably, the center portion 62 is recessed such that the center portion 62 has a curvilinear configuration when viewed in cross-section. The degree of recess or curvature of the center portion 62 can vary with the design parameters of the lid 10. Preferably, the degree of recess of the center portion 62 of the disk 50 is similar to the degree of recess of the center portion 36 of the cover 12. Alternatively, the inner portion 66 can be removed from the center portion 62 to reduce the weight and/or cost of the disk 50. In this configuration, the disk 50 has a ring-shaped configuration.

The projection 52 extends from a portion of the top wall 56. The projection 52 has a peripheral edge 68 that defines the shape of the projection 52. Preferably, the projection 52 is cooperatively dimensioned with the drink opening 28 such that at least a portion of the projection 52 is adapted to be received by or positioned in the opening 28. The projection 52 has a projection surface 52*a* that is preferably sloped or angled to facilitate reception of the projection 52 by the opening 28. When the projection 52 is completely received in the opening 28, the opening 28 is sealed and the lid 10 is in the closed position shown in FIG. 1. In the closed position, a top portion 70 of the projection 52 extends past the recessed portion surface 40*a*.

The post 54 extends from a portion of the top wall 56. As shown in FIG. 4, the post 54 has opposed end walls 72, opposed side walls 74, and a top wall 76. The post 54 can have either a solid or hollow construction depending upon design parameters. At least a portion of the post 54 is received by the slot 30 and extends past the top wall surface 14*a*. Although the configuration and dimensions of the post 54 can vary according to design parameters of the lid 10, the post 54 must retain a configuration that permits it to be received by the slot 30. As shown in FIG. 4, the post 54 has a catenoid shape. The post 54 can have a gripping portion (not shown) that is adapted to facilitate the engagement of a user's fingers with the post 54. The gripping portion can be integral to the post 54 or it can be a separate element fastened to a portion of the post 54. For example, the gripping portion can be a plastic or rubber element fastened to the walls 72, 74.

As shown in FIG. 4, the disk 50 has at least one aperture 78. The aperture 78 has a peripheral edge 80 that defines the shape of the aperture 78. When the aperture 78 is aligned with the drink opening 28, a passageway is formed between the disk 50 and the cover 12 permitting the passage or flow of the flowable substance held by the container through the lid 10. Although the aperture 78 can have a variety of configurations and dimensions, the aperture 78 is preferably cooperatively dimensioned with the drink opening 28. In a preferred embodiment, the aperture 78 is positioned within the disk 50 recessed portion 84 and spaced a distance from the projection 52. In another preferred embodiment, the disk 50 includes two separate apertures 78.

The disk recessed portion 84 is preferably positioned about the projection 52 and the aperture 78. The degree of recess of the portion 84 can vary. An edge 86 of recessed portion 84 defines the configuration of the recessed portion 84. Although the recessed portion 84 is shown positioned on a portion of both the disk side wall 59 and the disk top wall 56, the recessed portion 84 can be limited to either the side wall 59 or the top wall 56. The recessed portion 84 is adapted to be received by an inner surface of the recessed portion 40 of the cover 12 when the disk 50 is positioned proximate the cover 12. Accordingly, the shape and configuration of the recessed portion 84 of the disk 50 is similar to the shape and configuration recessed portion 40 of the cover 12. The top wall 56 and the side wall 59 cooperate to form a rounded edge 84*b* at the recessed portion 84.

As further shown in FIG. 4, the disk 50 has at least one well 90 depending from a portion of the disk 50. The disk 50 has a first well 90*a* and a second well 90*b* in one preferred embodiment. The well 90 can depend from either the top wall 56 or the side wall 59, or therebetween. The well 90 has an outer edge 92 that defines the general shape of the well 90. A shoulder 94 depends from the outer edge 92. The shoulder 94 can have a curvilinear portion 94*a* and a generally linear portion 94*b*. An inner wall 96 depends from the shoulder 94. As shown in FIG. 4, the inner wall 96 has a generally annular configuration resulting in a generally tubular well configuration. However, the well 90 can have a variety of configurations depending upon design parameters. Preferably, the well 90 has a bottom wall (not shown). Alternatively, the bottom wall is omitted, causing the well 90 to have a hollow, tubular configuration.

The first and second wells 90*a*, 90*b* can be positioned at various locations in the disk 50. Preferably, the first and second wells 90*a*, 90*b* are spaced a distance apart. The first well 90*a* and the second well 90*b* have the same dimensions and configurations. The depth or length of the well 90, as measured from a lower surface (not shown) of the disk 50 can vary. Similarly, the number and dimensions of the well 90, including the diameter, can vary with the numerous design parameters.

A drain hole (not shown) can be positioned in the disk 50, preferably in the center portion 62. When the flowable contents, i.e., liquid, accumulate between an interior surface of the cover 12 and the disk 50, the drain hole ensures the drainage of such contents into the container.

Referring to FIG. 1, the disk 50 and the cover 12 are cooperatively dimensioned such that the disk 50 can be positioned within an interior portion of the cover 12 to define an "assembled position." Referring to FIG. 3, in the assembled position, the disk 50 is rotatably supported by at least one support ledge 102 which is formed by the support member 34 extending radially inward as explained above. Specifically, a portion of the edge 51 of the disk 50 rotatably engages the support ledge 102. The disk 50 can be further rotatably supported by the interior edge 104 of the recessed portion 40. Although the cover 12 is shown in one preferred embodiment as having three support members 34 and three corresponding support ledges 102, the number and configuration of the members 34 and the ledges 102 can vary with the design parameters.

In the assembled position, the disk 50 is positioned proximate the cover 12 such that at least a portion of the post 54 is received by and extends through the slot 30. Described in a different manner, the disk 50 is positioned beneath the cover 12 such that the center portion 36 of the cover 12 is proximate the center portion 62 of the disk 50.

In the assembled position, the disk 50 is movable between a first position P1 and a second position P2. In the first position P1, as shown in FIG. 1, the projection 52 is received by the drink opening 28 such that the opening 28 is sealed and the lid 10 is closed. When the opening 28 is sealed, the edge 29 of the opening 28 is in frictional engagement with the projection 52. The top portion 70 of the projection 52 can extend past the edge 29 of the drink opening 28. This seal prevents the flow of the flowable substance in the container through the opening 28, enabling the container and lid 10 to be moved without risking spillage. Also, in the first position P1, the recessed portion 84 of the disk 50 is engaged with the recessed portion 40 of the cover 12. In addition, in the first position P1, the aperture 78 is misaligned or offset from the opening 28. Alternatively, the projection 52 and the opening 28 are in a snap fit engagement wherein each have sufficient structure to enable the snap fit engagement. Other cooperating structures can also be utilized.

In an alternate configuration of the disk 50, the projection 52 is omitted and the disk 50 has a generally planar surface (not shown). In the first position P1, the planar surface of the disk 50 is aligned with the opening 28 in a surface-to-surface engagement such that the opening 28 is sealed.

In the second position P2, a user engages the post 54 to rotate the disk 50 wherein the aperture 78 is aligned with the drink opening 28 to form a passageway between the disk 50 and the cover 12 wherein the lid 10 is open. The passageway permits the passage or flow of the flowable substance held by the container through the lid 10. When the lid 10 is in the second position P2, at least a portion of the edge 80 of the aperture 78 is aligned with at least a portion of the edge 29 of the drink opening 28. Also, in the second position P2, the recessed portion 84 of the disk 50 is misaligned or offset from the recessed portion 40 of the cover 12. In addition, in the second position P2, the projection 52 is misaligned or offset from the opening 28. When the aperture 78 is partially aligned with the drink opening 28, the passageway remains but its dimensions are reduced. When the aperture 78 is completely misaligned with the drink opening 28, the passageway is eliminated. When the aperture 78 is completely misaligned with the drink opening 28 and the projection 52 is completely received in the opening 28, the opening 28 is sealed and the lid 10 is in the first position P1.

When the disk 50 is moved between the first position P1 and the second position P2, a portion of the edge 51 of the disk 50 remains in rotatable engagement with the support ledge 102. Accordingly, the support ledge 102 provides support to the disk 50 such that the disk 50 remains in the assembled position during movement between the first and second positions, P1, P2. When the cover 12 includes a plurality of support ledges 102, a greater portion of the edge 51 of the disk 50 remains in rotatable engagement with the support ledges 102. The edge 104 of the recessed portion 40 provides additional support for the disk 50 as it is moved between the first and second positions P1, P2.

A user can move the disk 50 between the first position P1 and the second position P2 by grasping and actuating or manipulating the post 54 between the first end 30*a* of the slot 30 and the second end 30*b* of the slot 30. Referring to FIG. 1, when the post 54 is proximate the first end 30*a*, the disk 50 is in the first position P1. Conversely, when the post 54 is proximate the second end 30*b*, the disk 50 is in the second position P2. The post 54 can be located in a number of positions between the first and second ends 30*a*, 30*b* and as a result, the projection 52 can be misaligned with the opening 28 to varying degrees.

The disk 50 can be rotated or moved a varying amount depending upon the numerous design parameters of the lid 10, including but not limited to the configuration and dimensions of the post 54 and the slot 30. Thus, the disk 50 assumes a number of positions and those positions depend upon the location of the post 54 relative to the slot 30. The movement of the disk 50 and the post 54 is ultimately constrained by the first and second ends 30*a*, 30*b* of the slot 30.

The lid 10 is adapted to permit a user to move the post 54 between the first and second positions P1, P2 with only one hand. This means that a user can hold the container and manipulate the post 54 with the same hand. This increases the flexibility and the commercial value of the lid 10.

As explained above, the disk 50 can have two separate apertures 78, wherein the apertures 78 are positioned about the projection 52. In this configuration, the disk 50 can be rotated in either a clockwise or counter-clockwise direction to move the disk 50 between the first position P1 and the second position P2. For example, rotating the disk 50 in the clockwise direction brings one aperture 78 into alignment with the opening 28, while rotating the disk in the counter-clockwise direction brings the other aperture 78 into alignment with the opening 28. This feature further increases the flexibility and the commercial value of the lid 10. In such configuration, the length of the slot 30 is increased to allow for counterclockwise rotation of the disk 50 such that both apertures 78 can be aligned with the opening 28.

The lid 10 is adapted to be used without the disk 50. This means that the cover 12 is connected to a container but the disk 50 is omitted. In this configuration, there is no slot 30 and there is no structure to seal the opening 28 in the cover 12 and as a result, the flowable substance held by the container can pass through the lid 10. In this configuration, the recessed portion 40 remains positioned on both the top wall 14 and the side wall 16. However, the drink opening 28 can be positioned in either the top wall 14 or the side wall 16.

The opening 28 can be formed with a range of dimensions. At a minimum, the opening 28 should have dimensions sufficient to permit the passage of the flowable substance held by the container and receive the projection 52. The slot 30 can be formed with a range of dimensions. At a minimum, the slot 30 should have dimensions sufficient to receive and permit the movement of the post 54.

The opening 28 can be located at various positions along the top wall 14 depending upon design parameters. Similarly, the slot 30 can be located at various positions along the top wall 12. The opening 28 and the slot 30 are spaced a distance apart. Preferably, the opening 28 and the slot 30 are opposed on the top wall 12, meaning that they are positioned approximately 180 degrees apart. Alternatively, the post 54 is located on the sidewall 59 of the disk 50, and the slot 30 is cooperatively located on the sidewall 16 of the cover 12. In this configuration, a user moves the lid 10 between the first and second positions P1, P2 by engaging the post 54 that extends through the slot 30 positioned on the side wall 16 of the cover 12.

Although shown as having a generally circular shape, the lid 10, including the mounting portion 22, the flange 24 and the skirt 26, can have numerous configurations. For example, the lid 10 could have a rectangular, square, or oval shape. To ensure a leak-proof seal with the container, the shape of the mounting portion 22 should match the shape of the upper edge of the container so a cooperative sealing engagement can be achieved.

Alternatively, the mounting portion 22 could have a shape similar to the upper edge of the container, yet dissimilar from the shape of the side wall 16 and the top wall 14. For example, the mounting portion 22 could have an annular shape consistent with the container shape and the walls 14, 16 could have a non-annular shape.

Unlike prior art designs, the dimensions and the configuration of the opening 28 are not affected by the engagement and disengagement of the projection 52 as the disk 50 is moved between the first and second positions P1, P2. This attribute allows a user to repeatedly move the disk 50 between the first position and second position. Accordingly, the structural integrity and the durability of the lid 10 are increased.

The well 90 is adapted to aid in the storage and/or stacking of the disk 50 prior to the disk 50 and cover 12 being placed in the assembled position. Specifically, the well 90 is adapted to ensure that multiple disks 50 remain stacked in a stable vertical configuration prior to assembly of the lid 10. A portion of the well 90 of a first disk 50 engages a portion of well 90 of an adjacent second disk 50 positioned below the first disk 50. Accordingly, the well 90 should have a depth or length sufficient to permit it to engage a portion of the well 90 of the second disk 50. In an alternative configuration, the well 90 can be randomly placed wherein the well 90 of the first disk would rest on the top wall 56 of the second disk 50.

The well 90 is further adapted to aid in the storage and/or stacking of the assembled lid 10. Specifically, the well 90 is adapted to ensure that multiple lids 10 remain stacked in a stable vertical configuration. A portion of the well 90 of a first lid 10 engages a portion of an adjacent cover 12 of a second lid 10 positioned below the first lid 10. Accordingly, the well 90 should have a depth or length sufficient to permit it to engage a portion of the cover 12. The engagement of the well 90 with a portion of the cover 12 stabilizes the first and second lids 10 in their vertical position. The engagement of the well 90 with a portion of the cover 12 prevents the first and second lids 10 from becoming destabilized and/or misaligned.

The lid 10 can be formed by a variety of manufacturing processes, such as injection molding or a thermoforming operation, preferably vacuum forming and/or pressure forming. The cover 12 is preferably formed from plastic, however, other lightweight materials can be used to form the cover 12. After the manufacturing process has been completed, the drink opening 28 and the slot 30 may be formed in the cover 12 with a punch and die.

Preferably, the disk 50 is formed from the same material used to form the cover 12. However, the disk 50 can be formed from other lightweight materials. After the manufacturing process has been completed, the aperture 78 may be formed in the disk 50 with a punch and die.

The lid 10 can include a color-based system for indicating the status of the lid 10. Under the color-based system, a portion of the lid 10 would display a first color, e.g., red, when the lid 10 is closed in the first position P1. Similarly, a portion of the lid 10 would display a second color, e.g., green, when the lid 10 is open in the second position P2. The first and second colors would be displayed in a visible portion of the lid 10 such that a user of the lid 10 could readily ascertain the status of the lid 10. Referring to FIGS. 1 and 4, the first color is positioned on the disk 50 to the right of the post 54 and the second color is positioned on the disk 50 to the left of the post 54. Accordingly, when the lid 10 is in the closed position P1 shown in FIG. 1, the first color is visible through the slot 30. Conversely, when the lid 10 is in the open position P2, the second color is visible through the slot 30. In this manner, a user can verify the status of the lid 10 by simply looking at the color indicator displayed through the slot 30. As a result, the utility and marketability of the lid 10 is increased.

In an alternate color-based system configuration, the first color is positioned on the projection 52 wherein it is visible when the lid 10 is in the closed position P1. The second color is positioned on the edge 80 about the aperture 78 wherein it is visible when the lid 10 is in the open position P2. In this manner, a user can verify the status of the lid 10 by simply looking at the color indicator displayed in the opening 28.

Figure 5:
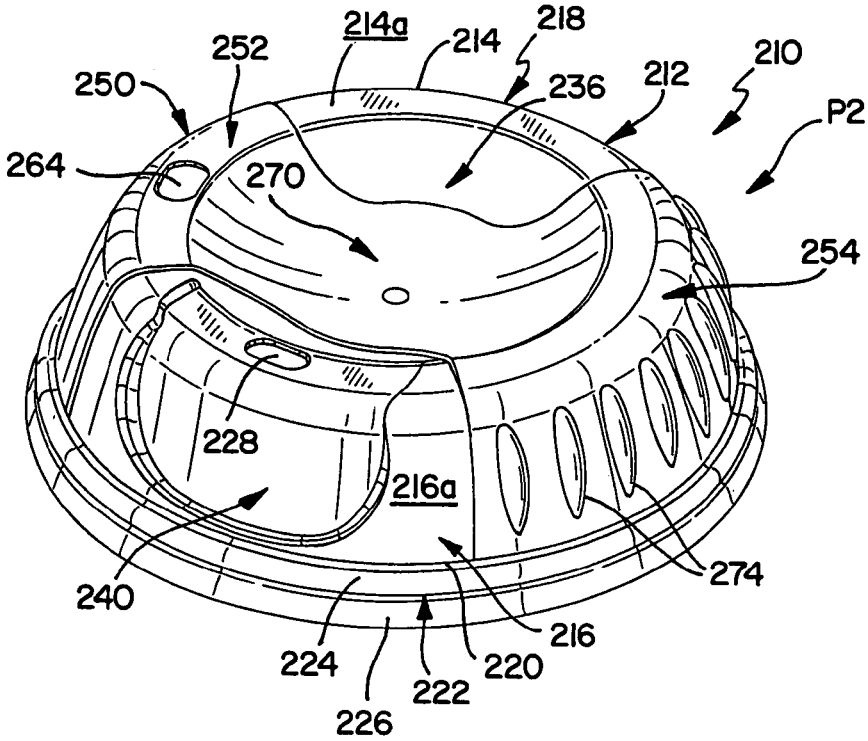
FIG. 5 is a perspective view of an alternate embodiment of a lid of the present invention, showing the lid in an open position.

FIGS. 5–8 disclose another preferred embodiment of the lid of the present invention. As shown in FIG. 5, the reclosable lid 210 generally includes a first piece or cover 212, and a movable second piece or overlay 250. FIG. 5 shows the lid 210 in the open position wherein the flowable substance can flow or pass through the lid 210 via opening 228.

Figure 6:
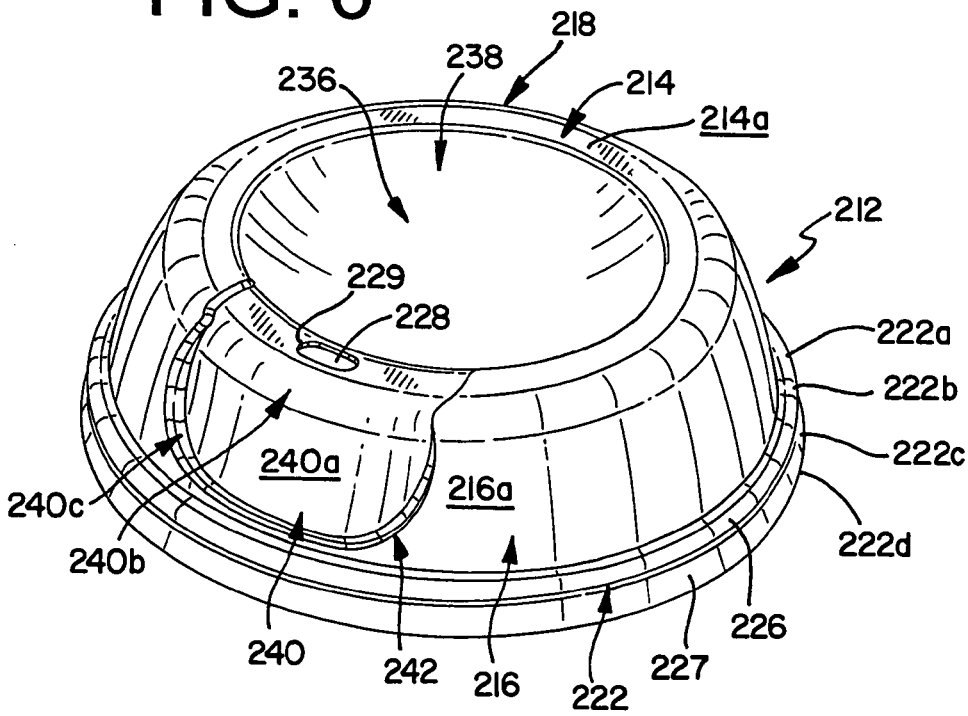
FIG. 6 is a perspective view of a cover of the lid of FIG. 5.

Referring to FIGS. 5 and 6, the cover 212 is adapted to span the opening in the upper portion of the container (not shown) that is generally defined by an upper rim or edge of the container. The cover 212 has an annular top wall 214 and a side wall 216 depending from an outer or peripheral edge 218 of the top wall 214. Although the top wall 214 is shown as having a generally flat upper surface 214*a*, the upper surface 214*a* can be curved or angled. The side wall 216 has a side wall surface 216*a* and a lower edge 220. The side wall surface 216*a* can be curved, angled, or generally flat. The overall shape of the cover 212 is generally frustaconical, however, the cover 212 can have a number of other configurations.

A mounting portion 222 depends from the lower edge 220 of the side wall 218. The mounting portion 222 includes a generally annular flange 224 and a generally annular skirt 226. The mounting portion 222 is adapted for connecting the lid 210 to the container in a manner that seals the lid 210 on the container. Thus, the mounting portion 222 prevents leakage of the container contents between the lid 210 and the container when the lid 210 is positioned on the container. In a preferred embodiment, the mounting portion 222 is integral with the side wall 16.

An aperture or drink opening 228 is located preferably in the top wall 216. Alternatively, the drink opening 228 is located in the side wall 216. The opening 228 is adapted to permit the passage or flow of the flowable contents held by the container through the cover 212. The opening 228 has an edge 229 that defines the shape of the opening 228. Although shown in FIG. 6 as having an obround shape, the opening 228 can have a variety of shapes, including but not limited to circular, square, or rectangular.

The opening 228 can be formed with a range of dimensions. At a minimum, the opening 228 should have dimensions sufficient to permit the passage of the flowable substance held by the container. The opening 228 can be located at various positions along the top wall 214 depending upon design parameters.

As shown in FIG. 6, a center portion 236 is positioned radially inward from an inner edge 238 of the top wall 214. Preferably, the center portion 236 is recessed such that the center portion 236 has a curvilinear configuration when viewed in cross-section. Described in a different manner, the center portion 236 has a concave shape when the portion 236 is viewed from a point above the lid 210. The degree of recess or curvature of the center portion 236 can vary with the design parameters of the lid 210.

Referring to FIGS. 5 and 6, the side wall 216 has a recessed portion 240 that is adapted to receive a lip of a person drinking from the container. An edge 242 of recessed portion 240 defines the configuration of the portion 240. The recessed portion 240 and the recessed surface 240*a* are positioned radially inward from the side wall surface 216*a*. Although the recessed portion 240 is shown positioned on both the top wall 214 and the side wall 216, the recessed portion 240 can be limited to either the top wall 214 or the side wall 216. The shape and configuration of the recessed portion 240 can be varied to conform to numerous design parameters. Similarly, the degree of recess of the portion 240 can vary. Preferably, the recessed portion 240 is positioned about the drink opening 228. The top wall 214 and the side wall 216 cooperate to form a rounded edge 240*b* at the recessed portion 240.

Figure 7:
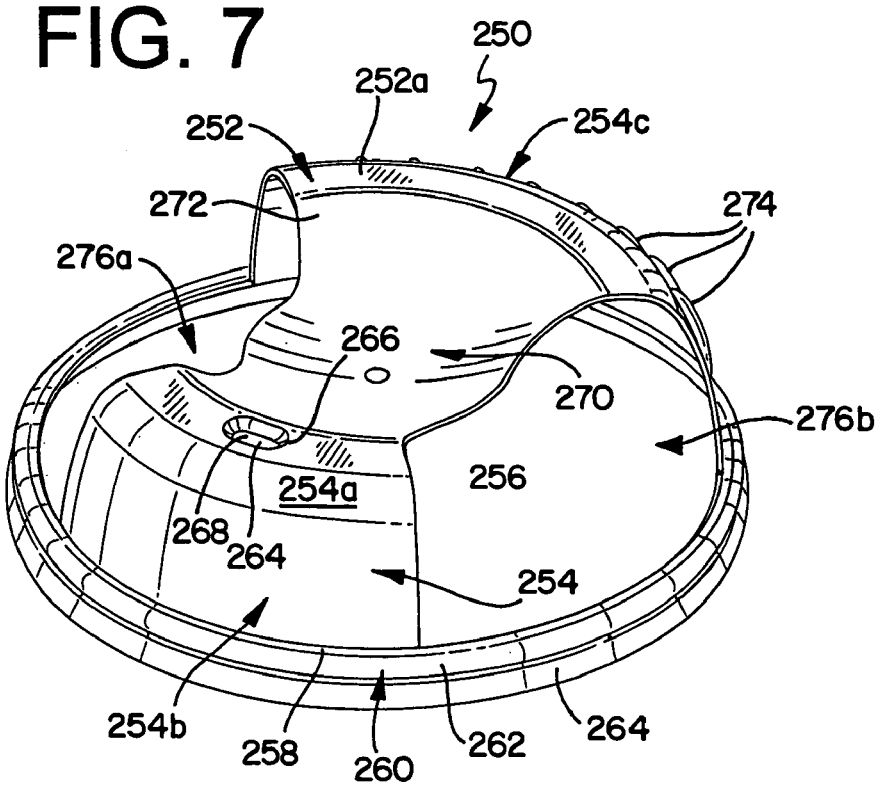
FIG. 7 is a perspective view of an overlay of the lid of FIG. 5.

As shown in FIGS. 5 and 7, the overlay 250 is a discontinuous structure adapted to be positioned about the cover 212. The overlay has a top wall 252 and a side wall 254 depending from an outer or peripheral edge 256 of the top wall 252. Although the top wall 252 is shown as having a generally flat upper surface 252*a*, the upper surface 252*a* can be curved or angled. The side wall 254 has a side wall surface 254*a* and a lower edge 258. The side wall surface 254*a* can be curved, angled or generally flat.

A mounting portion 260 depends from the lower edge 258 of the side wall 254. The mounting portion 260 includes a generally annular flange 262 and a generally annular skirt 264. The mounting portion 260 is adapted for rotatably connecting the overlay 250 to the mounting portion 222 of the cover 212 such that the overlay 250 and the cover 212 are in rotatable engagement. The mounting portions 222, 260 are cooperatively dimensioned such that the overlay 250 can be positioned about the cover 212 wherein the overlay 250 can be rotatably moved with respect to the cover 212. The mounting portions 222, 260 have a generally annular configuration. Alternatively, the mounting portions 222, 260 could have a configuration with angular or linear segments.

Preferably the mounting portions 222, 260 have a continuous configuration, as shown in FIGS. 5–8. Alternatively, the mounting portions 222, 260 have a discontinuous configuration, meaning that the portions 222, 260 have material removed that results in a notched configuration.

As shown in FIG. 7, the overlay 250 has a projection 264 that is located preferably in the top wall 252. Alternatively, when the drink opening 228 is positioned in the side wall 216 of the cover 212, the projection 264 is cooperatively positioned in the side wall 254 of the overlay 250. The projection 264 depends from a lower or inner surface (not shown) of the top wall 252. The projection 264 has a peripheral edge 266 that defines the shape of the projection 264. Preferably, the projection 264 is cooperatively dimensioned with the drink opening 228 such that at least a portion of the projection 264 is adapted to be received by or positioned in the opening 228. When the projection 264 is completely received in the opening 228, the opening 228 is sealed and the lid 210 is in the closed position shown in FIG. 8. In the closed position, a bottom wall 268 of the projection 264 extends past the top wall surface 214*a*.

As further shown in FIG. 7, a center portion 270 is positioned radially inward from an inner edge 272 of the top wall 252. Preferably, the center portion 270 is recessed such that the center portion 270 has a curvilinear configuration when viewed in cross-section. Described in a different manner, the center portion 270 has a concave shape when the portion 270 is viewed from a point above the lid 210. The degree of recess or curvature of the center portion 270 can vary with the design parameters of the lid 210. Alternatively, the center portion 270 is in planar alignment with the top wall 252. In this configuration, the center portion 270 is not recessed.

The overlay 250 has at least one gripping element 274 positioned on a portion of the side wall 254. The gripping element 274 is adapted to facilitate rotational movement of the overlay 250. Accordingly, a user engages the element 274 to aid in the rotation of the overlay 250. Although shown as having a generally elongated configuration, the element 274 can have a wide range of configurations and dimensions. In addition, the gripping element 274 can be positioned on the side wall 254, the top wall 252 or on a portion of both the side wall 254 and the top wall 252. Alternatively, the gripping element 274 is positioned on a portion of the mounting portion 260. The gripping element 274 can be integral to the overlay 250 or it can be a separate element fastened to a portion of the overlay 250. For example, the gripping portion can be a plastic or rubber element fastened to the overlay 250.

The overlay 250 can have alternate structures for facilitating movement of the overlay 250. For example, the overlay 250 could have a post or a ring extending from a portion of the overlay 250, each adapted for a user to engage and rotate the overlay 250.

Figure 8:
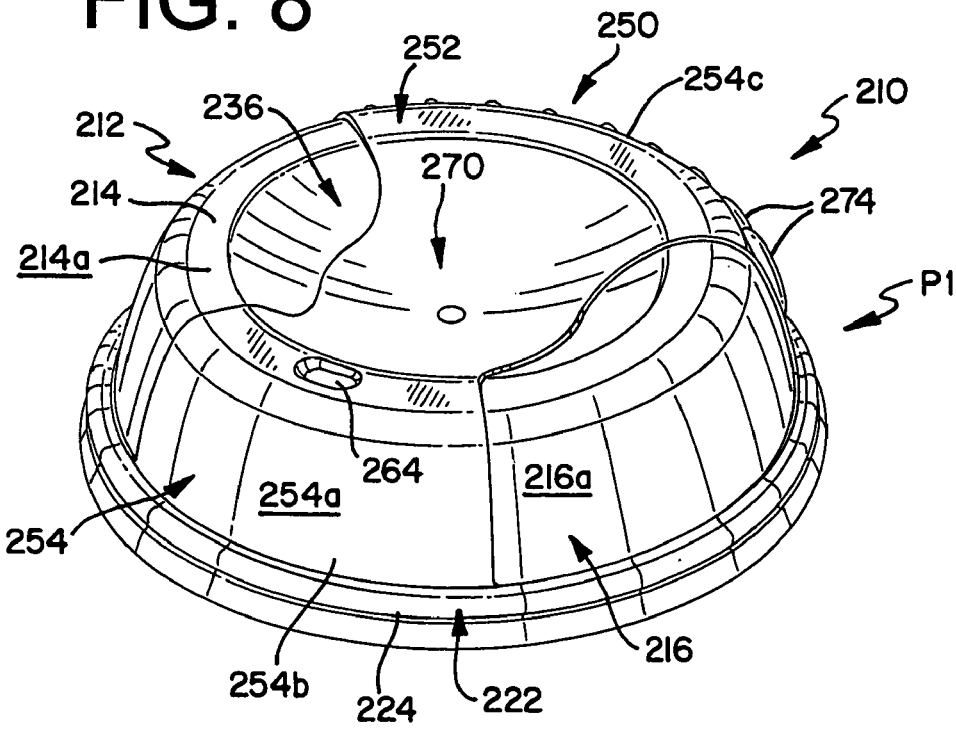
FIG. 8 is a perspective view of the lid of FIG. 5, showing the lid in a closed position.

As shown in FIGS. 5, 7 and 8, and as explained above, the overlay 250 has a discontinuous structure, meaning that neither the top wall 252 nor the side wall 254 are continuous along the circumference of the cover 250. As a result, the overlay has a first side wall portion 254*b* and a second side wall portion 254*c*. When the projection 264 is located in a portion of the top wall 252, the projection 264 is positioned proximate either of the side wall portion 254*b* or the second side wall portion 254*c*. Preferably, the gripping element 274 is positioned on the other of the wall portion 254*b* or the second side wall portion 254*c*. Alternatively, the gripping element 274 is positioned on the side wall portion 254*b*, 254*c* proximate the projection 264.

Due to its discontinuous configuration, the overlay 250 has an aperture 276. In one preferred embodiment, the overlay 250 has two aperture 276 wherein the portion of the overlay 250 above the mounting portion 262 has a generally hour-glass shape. The configuration and dimensions of the aperture 276 can vary greatly with the design parameters of the lid 210. Referring to FIG. 7, the overlay 250 has two separate apertures 276*a*, 276*b*. Each of the apertures 276*a,b* span a portion of the side wall 254, the top wall 252 and the center portion 270. Alternatively, the apertures 276*a*, 276*b* span only a portion of the side wall 254 and the top wall 252.

As shown in FIG. 5, the aperture 276 is adapted to permit the passage or flow of the flowable contents held by the container through the opening 228 when the aperture is generally positioned about the opening 228. Described in another manner, when the aperture 276 is aligned with the opening 228, the flowable contents can pass through the opening 228. Therefore, the aperture 276 should have a minimum configuration sufficient to permit the passage of the flowable contents through the aperture 228.

The cover 212 and the overlay 250 each have a generally thin-wall construction. However, the wall thickness of the cover 212 and the overlay 250 can vary depending upon the design parameters, including the structural integrity of the lid 210.

Referring to FIGS. 5 and 8, the overlay 250 and the cover 212 are cooperatively dimensioned such that the overlay 250 can be positioned on the cover 212 to define an "assembled position." In the assembled position, the overlay 250 is rotatably supported by the engagement of its mounting portion 260 and the mounting portion 222 of the cover 212. Specifically, a lower surface of the mounting portion 260 engages an upper surface of the mounting portion 222. Accordingly, the mounting portion 260 and the mounting portion 222 are cooperatively dimensioned such that the overlay 250 can be rotated with respect to the cover 212, where the cover 212 is generally fixed to the container.

In addition, the overlay 250 can be rotatably supported by the engagement of its center portion 270 and the center portion 236 of the cover 212. Specifically, a lower surface of the center portion 270 engages an upper surface of the center portion 236. Accordingly, the center portion 270 is cooperatively dimensioned with the center portion 236 of the cover 212. Alternatively, the lid 210 can be configured to have a clearance between the center portions 236, 270 such that the center portions 236, 270 are not in engagement. In this configuration, the overlay 250 rotatably engages the cover 212 by the engagement of the mounting portions 222, 260.

Alternatively, the overlay 250 can be rotatably supported by the engagement of its top wall 252 with the top wall 214 of the cover 212. Accordingly, the top wall 252 is cooperatively dimensioned with the top wall 214 of the cover 212. In another alternative, the overlay 250 can be rotatably supported by the engagement of its side wall 254 with the side wall 216 of the cover 212. Accordingly, the side wall 254 is cooperatively dimensioned with the side wall 216 of the cover 212.

In the assembled position, the overlay 250 is movable between a first position P1 and a second position P2. In the first position P1, shown in FIG. 8, the projection 264 is received by the drink opening 228 such that the opening 228 is sealed wherein the lid 210 is closed. When the opening 228 is sealed, the edge 229 of the opening 228 is in frictional engagement with the projection 264. A bottom portion (not shown) of the projection 264 can extend past the edge 229 of the drink opening 228. This seal prevents the flow of the flowable substance in the container through the opening 228, enabling the container and lid 210 to be moved without risking spillage. Also, in the first position P1, the aperture 276 is misaligned or offset from the opening 228. Alternatively, the projection 264 and the opening 228 are in a snap fit engagement wherein each have sufficient structure to enable the snap fit engagement. Other cooperating sealing structures can also be utilized.

In the second position P2, shown in FIG. 5, a user rotates the overlay 250 wherein the aperture 276 is aligned with the drink opening 228 to form a passageway between the overlay 250 and the cover 212. In the second position P2, the lid 210 is open. The passageway permits the passage or flow of the flowable substance held by the container through the lid 210. When the lid 210 is in the second position P2, at least a portion of the aperture 276 is aligned with at least a portion of the edge 229 of the drink opening 228. Also, in the second position P2, at least a portion of the recessed portion 240 of the cover 212 is aligned with the aperture 276. In addition, in the second position P2, the projection 264 is misaligned or offset from the opening 228. When the aperture 276 is partially aligned with the drink opening 228, the passageway remains but its dimensions are reduced.

When the overlay 250 is moved between the first position P1 and the second position P2, the mounting portion 260 of the overlay 250 remains in rotatable engagement with at the mounting portion 222 of the cover 212. Accordingly, the mounting portions 222, 260 provide support to the overlay 250 such that the overlay 250 remains in the assembled position during movement between the first and second positions, P1, P2.

When the overlay 250 is moved between the first position P1 and the second position P2, the center portion 270 of the overlay 250 remains in rotatable engagement with the center portion 236 of the cover 212. Accordingly, the center portions 236, 270 provide an additional amount of support to the overlay 250 such that the overlay 250 remains in the assembled position during movement between the first and second positions, P1, P2.

A user can move the overlay 250 between the first position P1 and the second position P2 by grasping and manipulating a portion of the overlay 250, for example, the side wall 254, the top wall 252 or the mounting portion 260. Alternatively, when so configured, the user can move the overlay 250 between the first and second positions P1, P2 by engaging the gripping element 274.

The overlay 250 can be rotated or moved a varying amount depending upon the numerous design parameters of the lid 210, including but not limited to the configuration and dimensions of the side wall 254, the mounting portion 260, the projection 264 and the aperture 276. Thus, the overlay 250 can assume a number of positions with respect to the cover 212. The lid 210 is adapted to permit a user to move the overlay 250 between the first and second positions P1, P2 with only one hand. This means that a user can hold the container and manipulate the overlay 250 with the same hand. This increases the flexibility and the commercial value of the lid 210. As shown in FIG. 5, 7 and 8, the overlay 250 has two separate apertures 276 which permit the overlay 250 to be rotated in either a clockwise or counter-clockwise direction to move the overlay 250 between the first position P1 and the second position P2. This feature further increases the flexibility and the commercial value of the lid 210.

The lid 210 is adapted to be used without the overlay 250. This means that the cover 212 is connected to a container but the overlay 250 is omitted. In this configuration, there is no structure to seal the opening 228 in the cover 212 and as a result, the flowable substance held by the container can pass through the lid 210. In this configuration, the recessed portion 240 remains positioned on both the top wall 214 and the side wall 216. However, the drink opening 228 can be positioned in either the top wall 214 or the side wall 216.

Although shown as having a generally circular shape, the lid 210, including the mounting portions 222, 260, can have numerous configurations. For example, the lid 210 could have a rectangular, square, or oval shape. To ensure a leak-proof seal with the container, the shape of the mounting portion 222, 260 should match the shape of the upper edge of the container so a cooperative sealing engagement can be achieved.

Alternatively, the mounting portions 222, 260 could have a shape similar to the upper edge of the container, yet dissimilar from the shape of the side walls 216, 254 and the top walls 214, 252. For example, the mounting portions 222, 260 could have an annular shape consistent with the container shape and the side walls 216, 254 and/or the top walls 214, 252 could have a non-annular shape.

Unlike prior art designs, the dimensions and the configuration of the opening 228 are not affected by the engagement and disengagement of the projection 264 as the overlay 250 is moved between the first and second positions P1, P2. This attribute allows a user to repeatedly move the overlay 250 between the first position Pt and the second position P2. Accordingly, the structural integrity and the durability of the lid 210 are increased.

The lid 210 can be formed by a variety of manufacturing processes, such as injection molding or a thermoforming operation, preferably vacuum forming and/or pressure forming. The cover 212 is preferably formed from plastic, however, other lightweight materials can be used to form the cover 212. After the manufacturing process has been completed, the drink opening 228 may be formed in the cover 212 with a punch and die. The aperture 276 could also be formed with a punch and die.

Preferably, the overlay 250 is formed from the same material used to form the cover 212. However, the overlay 250 can be formed from other lightweight materials.

The cover 212 can have at least one cover drain hole (not shown), preferably positioned in the center portion 236 near a lowermost portion of the center portion 236. When excess flowable contents, e.g., liquid, accumulate on the cover 212, the drain hole ensures the drainage of such contents into the container.

The overlay 250 can have an overlay drain hole (not shown), that is cooperatively dimensioned with the cover drain hole described above. The overlay drain hole is cooperatively positioned with the cover drain hole such that when the overlay 250 is rotated to the first position P1, the cover drain hole and the overlay drain hole align to form a passageway that ensures the drainage of accumulated container contents. Alternatively, the overlay drain hole is cooperatively positioned with the cover drain hole such that when the overlay 250 is rotated to the second position P2, the cover drain hole and the overlay drain hole align to form the passageway.

The cover 212 can have at least one cover vent hole (not shown), preferably in the center portion 236 or the side wall 216. Alternatively, the cover vent hole is positioned in a portion of the top wall 214 or a portion of the side wall 216. The cover vent hole is adapted to ensure the continuous flow of the container contents though the opening 228 while venting the container. Preferably, the cover vent hole is positioned such that the venting of the container occurs while the lid 210 is in the second position P2.

The overlay 250 can have an overlay vent hole (not shown), that is cooperatively dimensioned with the cover vent hole described above. The overlay vent hole is cooperatively positioned with the cover vent hole such that when the overlay 250 is rotated to the second position P2, the cover vent hole and the overlay vent hole align to form a passageway that ensures the venting of the container.

The drain holes and the vent holes described above can be formed with a punch and die after the lid 210 manufacturing process has been completed. Alternatively, a pointed tool may be used to form the drain holes and the vent holes.

In another preferred embodiment (not shown), the lid has at least one pin on either the overlay or the cover. In addition, the lid has at least one socket on the other of the overlay or the cover. The pin and the socket are cooperatively dimensioned such that when the pin is received by the socket, the overlay is in rotational engagement with the cover. Because the overlay and the cover are in rotational engagement, the lid can be rotated between the first and second positions P1, P2. The pin and socket are adapted to support the overlay when the lid is rotated between the first and second positions P1, P2.

The cover has a center portion that can be recessed. The overlay is a discontinuous structure that is adapted to be positioned about the cover. The overlay has at least one aperture that is alignable with an opening in the cover. Preferably, the pin depends from a lower surface of the overlay, and the socket depends from an upper surface of the cover. In this configuration, the socket is positioned in the center portion of the cover.

The overlay can include an annular mounting portion that engages a mounting portion of the cover. The overlay mounting portion supports the overlay during movement between the first and second positions. Alternatively, the overlay includes a mounting portion but it is segmented, meaning that it is not annular.

In another alternative, the annular mounting portion is omitted from the overlay. In this configuration, the pin and socket primarily support the overlay when the lid is rotated between the first and second positions P1, P2.

Figure 11:
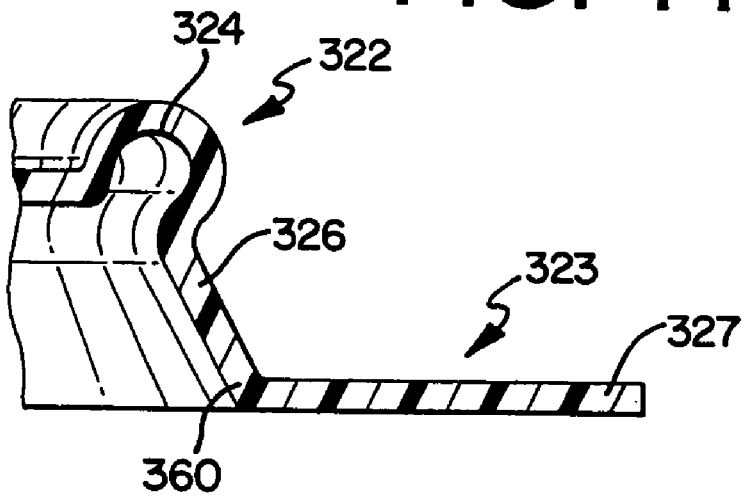
FIG. 11 is a partial cross-section of the lid taken along line 11—11 of FIG. 10, showing the tab.

FIGS. 9 and 10 disclose an alternate embodiment of a lid of the present invention, generally designated with the reference numeral 310. The lid 310 generally includes a cover 312 and the movable or rotatable element or disk 50, and the similar elements thereof retain their reference numerals. The lid 310 is shown having a tab 323 extending from a portion of the cover 312. The tab 323 is adapted to permit a user to easily position and/or remove the lid 310 from a container 325. The tab 323 extends radially outward from the mounting portion 322. Described in a different manner, the tab 323 extends radially from the peripheral edge 360 of the skirt 326. However, the tab 323 can extend from a different portion of the cover 312, including the side wall 16 or the flange 324. Although a single tab 323 is shown, the lid 310 can have a plurality of tabs 323 wherein the tabs 323 are spaced about the mounting portion 322. The tab 323 has a curved peripheral edge 327 that causes the tab 323 to have a curvilinear configuration. Alternatively, the tab 323 has an angular or linear configuration. As shown in FIG. 11, the thickness of the tab 323 generally corresponds to the thickness of the mounting portion 322. However, the thickness of the tab 323 can be either increased or decreased as necessary.

Figure 12:
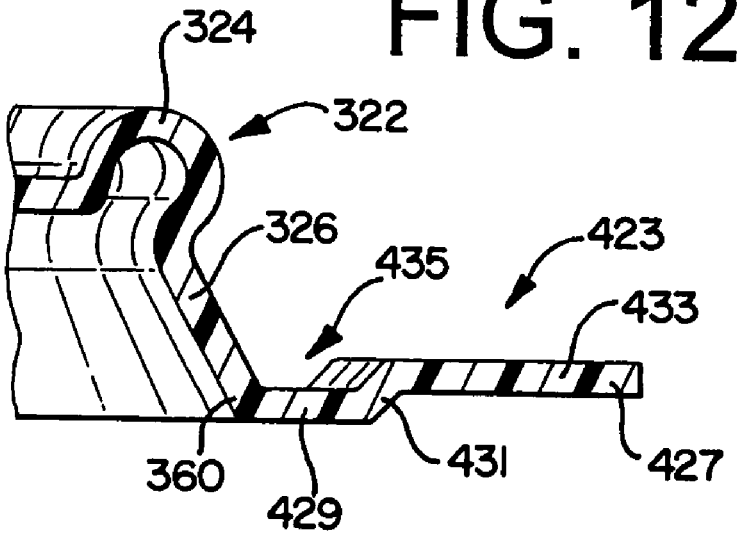
FIG. 12 is a partial cross-section of the lid taken along line 11—11 of FIG. 10, showing an alternate tab.

An alternate tab 423 extending from the mounting portion 322 is shown in FIG. 12. The tab 423 has a curvilinear configuration with a first segment 429, a second segment 431, and a third segment 433. The first segment 429 extends radially outward from an edge 360 of the skirt 326. The second segment 431 is angled or sloped upward from the first segment 429 to the third segment 433 whereby the tab 423 has a "stepped" configuration. The third segment 433 has a rounded edge 427 which causes the tab 423 to have a curvilinear configuration. Alternatively, the third segment 433 has a squared end or terminus. When viewed from above, a channel 435 is defined by the skirt 326, the first segment 429, and the second segment 431. The first segment 429 defines a first plane, the second segment 431 defines a second plane, and the third segment 433 defines a third plane. Due to the angled second segment 431, the first plane and the third plane are misaligned. Described in a different manner, the first plane is not in planar alignment with the third plane. Further, neither the first plane nor the third plane are in planar alignment with a plane defined by the flange 324. In another alternative (not shown), the tab has a second segment that is angled or sloped downward from the first segment towards the third segment causing the tab to have a stepped configuration in a downward direction. With this alternate design, the third segment is positioned lower than the skirt of the mounting portion.

As described above, the lid 310, or portions thereof can be formed by a variety of manufacturing processes, such as injection molding or a thermoforming operation, preferably vacuum forming and/or pressure forming. However, the primary components of the lid, the cover 312 and the rotatable element 50, can be formed from distinct processes. For example, the cover 312 can be thermoformed while the rotatable element 50 can be injection molded. Furthermore, the cover 312 and/or the element 50 can be co-injection molded, meaning that multiple polymers can be used to form the element 50. For example, the rotatable element 50 can be formed from a thermoplastic polymer and a thermoset polymer. In addition, an additive such as a filler, plasticiser, stabilizer, or colorant can be utilized to form the cover 312 and/or element 350.

Preferably, the tab 323 is integrally formed with the cover 312. Preferably, the thickness of the tab 323 corresponds with the cover 312, however, it can differ based upon design parameters of the lid 310. A conventional cutting tool is used to trim excess material from the lid 310 to form the tab 323. The precise configuration and/or thickness of the tab 323 can be revised by the changing the operating parameters of the cutting tool.

As also mentioned above, the tab 323 is adapted for a user to easily position and/or remove the lid 310 from the container 325. When the lids 310 are stacked in a vertical arrangement at a retail distribution point, an employee can grasp the tab 323 to quickly separate the uppermost lid 310 from others within the stack. The tab 323 furthers the assembly of the cover 312 and the rotatable element 50. During the step of assembling the cover 312 and the rotatable element 50, the tab 323 helps to fix the position of the cover 312 such that the rotatable element 50 can be properly positioned within the interior region of the cover 312. The tab 323 enhances the alignment between the cover 312 and the element 50 to effectuate the assembly of the lid 310. Referring to FIG. 10, the tab 323 of the lid 310 is shown positioned between a pair of guides or pegs G, which typically extend from a piece of equipment or tooling. Alternatively, the tab 323 is positioned against a single guide G. The interaction between the guides G and the tab 323 secures the lid 310 in a pre-assembly position wherein the cover 312 is separated from the rotatable element 50. In the pre-assembly position, the precise location of the slot 30 is fixed to facilitate reception of the actuator 54. Described in a different manner, the angular orientation of the cover 312, including the slot 30 is fixed. While the tab 323 is positioned between the guides G, the rotatable element 50 is moved towards the interior region of the cover 312. To reach an assembled position, the rotatable element 50 is positioned within the interior region of the cover 312 whereby the actuator 54 is received by the slot 30. In addition, the rotatable element 50 is positioned such that it rotatably engages the support members 102. Thus, the tab 323 helps to ensure the proper assembly and formation of the lid 310. In addition to providing positioning benefits during assembly of the lid 310, the tab 323 provides positioning benefits during the use of the lid 310. Specifically, the tab 323 provides tactile feedback for a user to determine the position of the drink opening 28 with respect to the position of the tab 323. This aspect is beneficial in low light conditions.

As shown in FIG. 1, the cover 12 has a drink opening 28 that is adapted to receive the projection 52 of the rotatable element 50 in the first position P1. The drink opening 28 is shown as being positioned in the top wall 14 of the cover 12. However, a spout can extend upward in a generally vertical manner from the top wall 14 and include a drink opening. In this manner, the drink opening is positioned above the top wall 14 due to the spout. In the first position P1, the flowable contents of the container flow through the aperture 78 of the element 50 and the spout. The spout can extend upwardly from the top wall 14 or a combination of the top wall 14 and the central region 36. Preferably, the spout is integrally formed with the cover 12. The dimensions of the spout, including the height and the width, vary with the design parameters of the lid 10. Preferably, the spout is cooperatively dimensioned with the projection 52 such that a base region of the spout receives the projection 52 to generally seal the opening 28 of the lid 10 in the second position P2.

Figure 13:
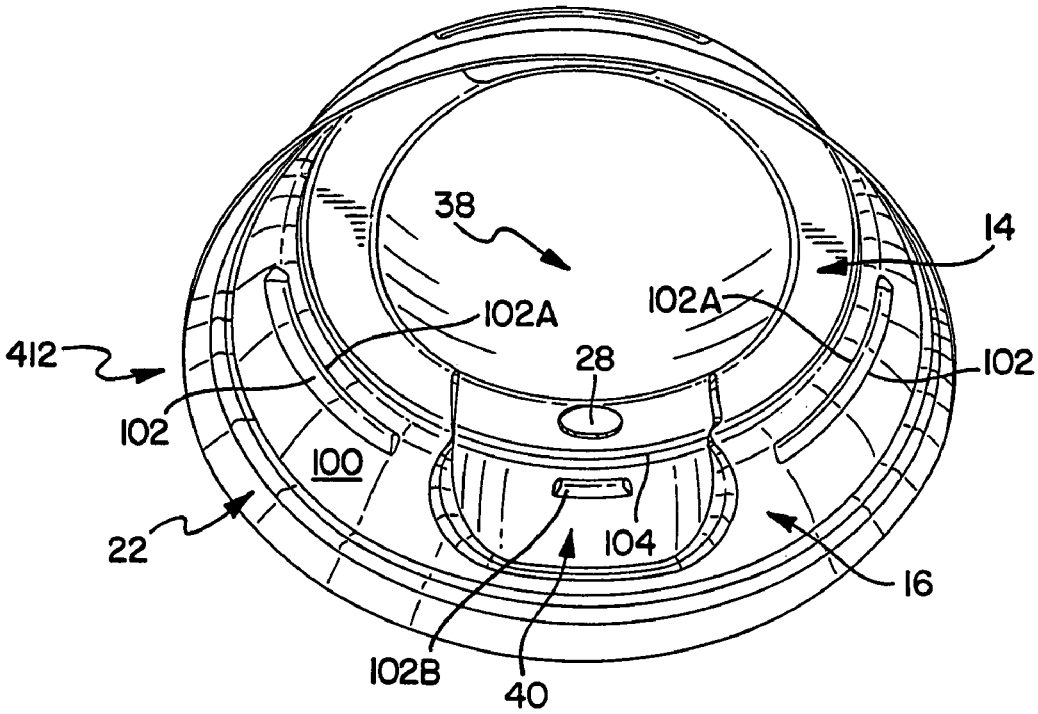
FIG. 13 is a perspective view of an alternate embodiment of a lid of the present invention, showing an interior cavity of the lid.

Referring to FIG. 3 and as mentioned above, the cover 12 has a plurality of support members 34 and support ledges 102, where the support ledges 102 extend into the interior region of the cover 12 from the side wall 16. As shown in FIG. 13, a cover 412 has a support ledge 102B that is positioned within the recessed portion 40 of the side wall 16 and near the drink opening 28. Alternatively, the recessed portion 40 is omitted and the support ledge 102B is positioned near the drink opening 28. In yet another alternative, a pair of support ledges 102B can extend inward from the side wall 16 and be positioned about the drink opening 28. As fully explained above, the rotatable element 50 is rotatably supported by the ledges 102 such that the element 50 is moveable between the first and second positions P1, P2. As shown in FIG. 13, the support ledge 102B has a reduced length compared to the other support ledges 102. However, the dimensions including the length of the support ledges 102, 102B can vary with the design parameters of the cover 12. The positioning of the support ledge 102B near the drink opening 28 enhances the operation of the rotatable element 50. In the first or closed position P1, the support ledge 102B provides further support to the element 50 such that the projection 52 is properly received by the drink opening 28. In the second or open position P2, the support ledge 102B provides further support to the element 50 such that the aperture 78 remains properly aligned with the drink opening 28. Furthermore, in either position P1, P2, the interaction between the support ledge 102B and the rotatable element 50 minimizes the chance for seepage past the element 50 in the region about the drink opening 28. Although the cover 412 is shown as not having the tab 323 of FIGS. 9–11, it is understood that the cover 412 can have a tab and that such structure will not interfere with the operation of the lid 412.

As shown in FIG. 13, the support ledges 102, 102B extend radially inward from the inner surface 100 of the side wall 16 of the cover 412. Alternatively, the cover 412 has a support channel in the side wall 16 wherein the channel is adapted to rotatably support the element 50. In this manner, the support channel is recessed into the side wall 16 such that it does not extend beyond the inner surface 100. The support channel can be positioned along the entire circumference of the side wall 16, or an extent of the circumference. The support channel can be continuous or interrupted, meaning spaced along the circumference of the side wall 16. Preferably, the element 50 has a rib or rail that is received by the support channel to rotatably support the element 50. To ensure proper rotation of the rotatable element 50, the rib and the support channel are cooperatively dimensioned. The rib can extend from a number of locations of the element 50, including the top wall 56, the side wall 59, or the lower edge 51. Like the support channel, the rib can be continuous or interrupted. For larger containers, the size of the cover 12 can be increased such that cover 12 has a plurality of support channels and the rotatable element 50 has a corresponding number of cooperating ribs. Preferably, the support channel in the side wall 16 is dimensioned to receive only the rib of the element 50. Alternatively, the height of the support channel is increased such that a greater extent of the element 50 is rotatably received. This means at least the outer edge 51 and the side wall 59 of the element 50 are received by the larger support channel. In another alternative, the support channel and rib configuration is reversed such that the rotatable element 50 has a recessed channel that receives a rib of the cover 12.

As explained above, the rotatable element 50 is moveably supported by support ledges 102 located in the side wall 16. Alternatively, the rotatable element 50 is rotatably supported by other portions of the cover 12 such as the top wall 14 and/or the central portion 36 of the cover 12. Thus, the top wall 14 could have at least one structure adapted to rotatably support the element 50. For example, a support ledge 102 can depend from the top wall 14 and rotatably support the element 50. In this configuration, the support ledge 102 depends from the top wall 14 at a position radially inward of the peripheral edge of the top wall 14. This support ledge 102 has a horizontal component that engages and rotatably supports the element 50, which can be a ring-shaped structure. As another example, a support ledge 102 can depend from the central portion 36 and rotatably support the element 50. As yet another example, a support ledge 102 can extend from the point where the top wall 14 and the side wall 16 converge. In is further understood that the element 50 could be rotatably supported on a top surface of the cover 12.

Figure 14:
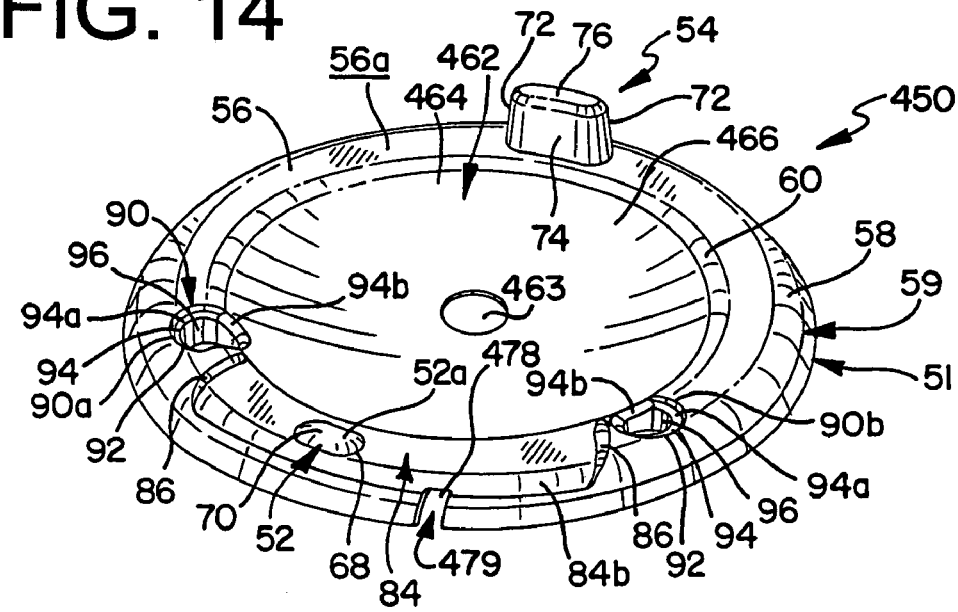
FIG. 14 is a perspective view of an alternate embodiment of a rotatable element for a lid of the present invention.

Referring to FIG. 4, the rotatable element or disk 50 has an aperture 78 that is aligned with the drink opening 28 in the second or open position P2. Alternatively and as shown in FIG. 14, the aperture 78 is omitted and the element 450 has at least one structure configured to define a passageway for the flow of the container contents. In a preferred embodiment, the element 450 has a notch 478 that defines a channel or passageway 479. The dimensions of the passageway 479 are determined by the width and length of the notch 478. The notch 478 extends radially inward from the outer edge 51 of the element 450. The notch 478 terminates prior to the top wall 56 of the element 450. However, the notch 478 can extend into the top wall 56 and/or into the inner shoulder 60 of the element 450. The notch 478 is positioned adjacent the recessed portion 84 of the element 450. In the first position P1, the notch 478 is misaligned with the drink opening 28 causing misalignment between the passageway 479 and the opening 28. In the second position P2, the notch 478 is generally aligned with the drink opening 28 causing the passageway 479 to be aligned with the opening 28. As a result, the passageway 479 permits the passage of the flowable substance held by the container through the lid 10.

In yet another alternative, the element 450 has an upwardly directed or raised segment that defines a channel or passageway. To prevent binding of the rotatable element during its movement between the first and second positions P1, P2, the height of the raised segment corresponds to the height of the projection 52.

As discussed above and as shown in FIG. 14, the center or central portion 462 of the rotatable element 450 has an opening 463. As a result of the opening 463, the element 450 has a ring-shaped configuration. The opening 463 is adapted to permit the drainage of the liquid contents of the container pass between the element 450 and the cover 12. Although the diameter of the opening 463 is shown as roughly corresponding to the diameter of the wells 90, the size of the opening 463 can vary with the design parameters of the rotatable element 450. As a result, the dimensions of the ring-shaped element 450 will vary. For example, the diameter of the opening 463 is increased and the width of the center portion 462 corresponds to the width of the top wall 56 of the rotatable element 450.

In another embodiment, the rotatable element 50 has a band extending radially outward from the peripheral or outer edge 51 proximate the projection 52. The band is adapted to increase the sealing of the drink opening 28 by the projection when the lid 10 is in the closed or first position P1. Preferably, the band has a rectangular configuration and extends outward from the recessed portion 84 of the element 50. When the lid 10 is in the closed position P1, the band is positioned beneath the drink opening 28 and against the inner surface 100 of the cover 12. In this manner, the band helps to further seal the drink opening 28 in the closed position P1. The rotatable element 50 could also have a projection 52 with pliable characteristics to assist in sealing the drink opening 28. This type of projection 52 can be formed, for example, using a two-shot injection molding process.

In another embodiment, the rotatable element 50 has a recessed portion 84 with a vertical side wall 59. When the element 50 is viewed from the side, the vertical side wall 59 forms a shoulder or ledge (not shown) near the peripheral edge 51 of the element 50. The shoulder has a vertical wall component that originates at the peripheral edge and terminates near the edge 80 of the aperture 78. The shoulder extends an extent of the recessed portion 84. Preferably, the shoulder extends along the projection 52 and the aperture 78. The vertical side wall 59 is adapted to aid the interaction between the recessed portion 84 and the recess 40 of the cover 12.

Figure 15:
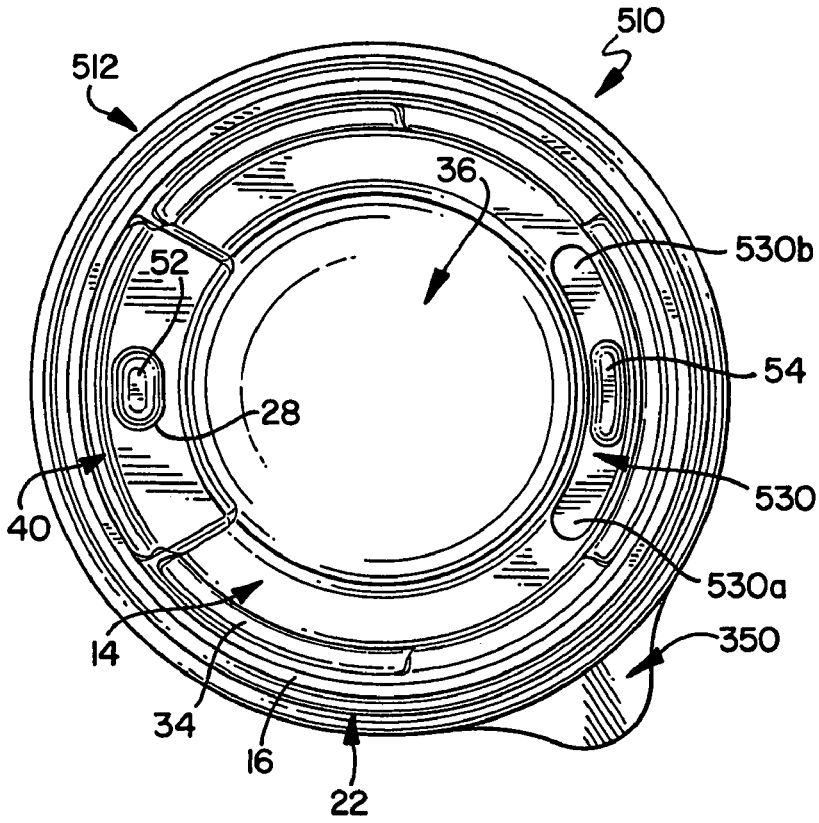
FIG. 15 is a top plan view of an alternate embodiment of a lid of the present invention, showing a lid with a cover having an enlarged slot.
Figure 16:
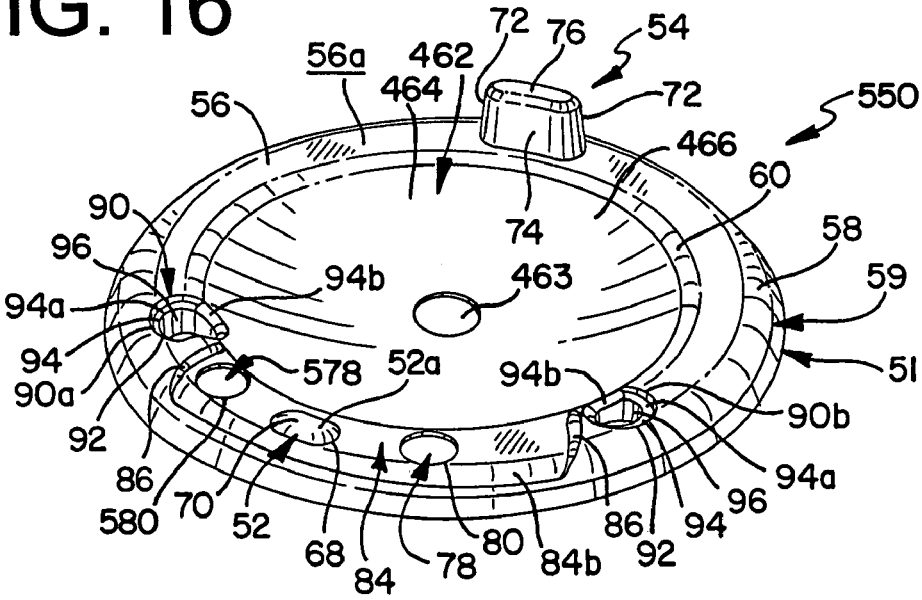
FIG. 16 is a perspective view of a rotatable element of the lid of FIG. 15, showing the element having a pair of apertures.
Figure 19:
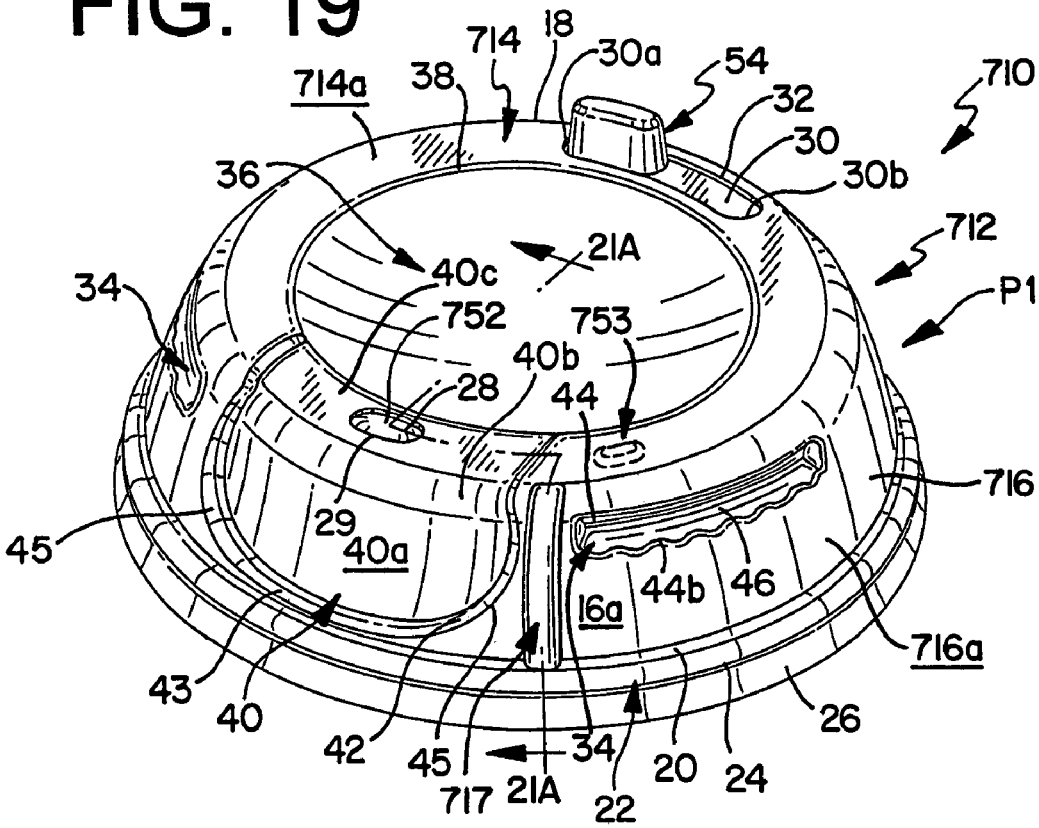
FIG. 19 is a perspective view of an alternate embodiment of a lid of the present invention, showing a cover and a rotatable element.
Figure 20:
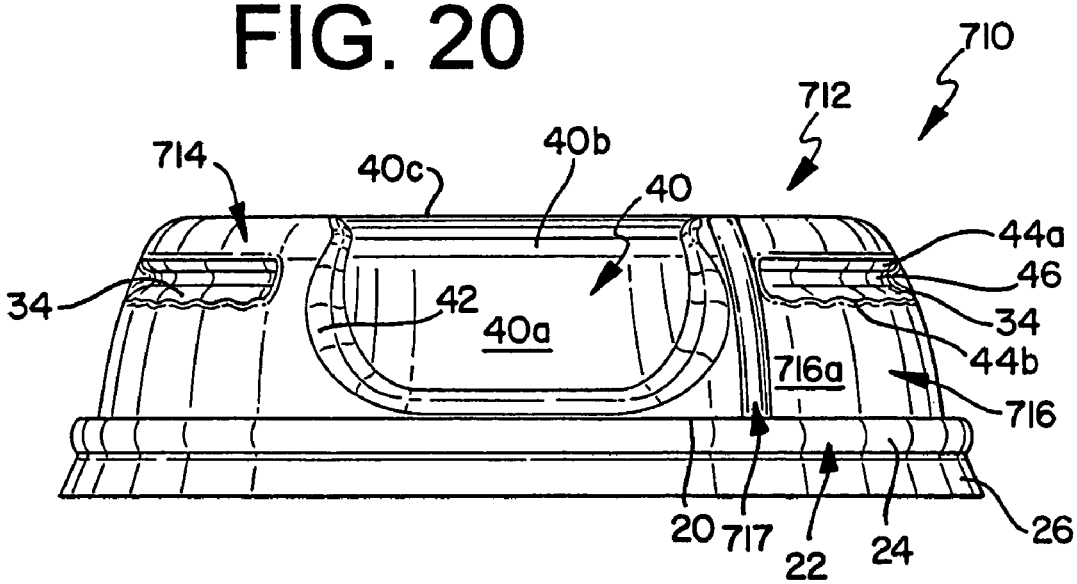
FIG. 20 is an end view of the lid of FIG. 19, showing the cover.

FIGS. 15 and 16 disclose an alternate embodiment of a lid of the present invention generally designated with the reference numeral 510. The lid 510 generally has a cover 512 and the rotatable element 550, and the similar elements thereof retain their reference numerals. The lid 510 has a slot 530 with increased dimensions. Specifically, the arc length of the slot 530 is increased. In the first or closed position P1 shown in FIG. 15, the actuator 54 is positioned between a first slot portion 530*a* and a second slot portion 530*b*. Thus, two distinct slot portions 530*a, b* flank the actuator 54 in the first position P1. In the first position P1, the actuator 54 is positioned at the general midpoint of the slot 530. The rotatable element 550 has a first aperture 78 and a second aperture 578, wherein the apertures 78, 578 are positioned about the projection 52. Preferably, the second aperture 578 is positioned in the recessed portion 84 of the element 550. Like the first aperture 78, the second aperture 578 has a peripheral edge 580 that defines the shape of the aperture 578. When the second aperture 578 is aligned with the drink opening 28, a passageway is formed between the disk 50 and the cover 512 permitting the passage or flow of the flowable substance held by the container through the lid 510. To move the lid 510 from the first position P1 to the open or second position P2, a user actuates the actuator 54 in either a clockwise or counter-clockwise direction such that either the first aperture 78 or the second aperture 578 is aligned with the drink opening 28. Therefore, the lid 510 is capable of movement in one of two distinct directions from the first position P1 to the second position P2, which increases the utility of the lid 510. Alternatively, the lid 510 has a pair of projections 52 positioned about the first aperture 78. In this configuration, to move the lid 510 from the second position P2 to the closed or first position P1, a user actuates the actuator 54 in either a clockwise or counter-clockwise direction such that either the first projection 52 or the second projection 52 is received by the drink opening 28.

Although the rotatable element 50 is shown in FIG. 4 as having a disk configuration, the element 50 can have a variety of configurations. For example, the rotatable element 50 can have a ring-shaped configuration. Also, at least one spoke or rib can be added to the ring-shaped element 50 to increase its structural integrity. The spoke(s) can have a recessed central portion that corresponds with the recessed-configuration of the central region 36 of the cover 12. Alternatively, the rotatable element 50 can have a hour-glass shaped configuration where the portions not having either the post 54 or the recessed portion 84 are removed. This configuration reduces the quantity of material used to fabricate the rotatable element 50.

Again referring to FIG. 4, the rotatable element 50 has an actuator 54 defined by a post that extends generally upward from a top wall 56 of element 50. Alternatively, the post 54 depends downward from the top wall 56 to define a well. The well is cooperatively dimensioned with the slot 30 of the cover 12 such that a user can actuate the lid 10 between the first position P1 and the second position P2. For example, a user can insert a finger into the slot 30 and the well formed by the depending post 54 to actuate the element 50 between the first and second positions P1, P2. Thus, the well is adapted to receive a user's finger to actuate the rotatable element 50. In another alternative, the actuator 54 is defined by a plurality of protrusions such that a user can engage the protrusions to actuate the rotatable element 50 between the first and second positions P1, P2.

FIGS. 17 and 18 disclose an alternate embodiment of a lid of the present invention generally designated with the reference numeral 610. As shown therein, the support members 34 and the resulting support ledges 102 are omitted from the side wall 616 of the cover 612. Also, the actuator or post 654 of the rotatable element 650 has a flange 671 that is adapted to slidingly engage the top wall 14 of the cover 612. As explained above, in an assembled position, the post 654 extends through the slot 30 in the cover 612 wherein the flange 671 slidingly engages a portion of the top wall 14 of the cover 12. This means that a lower surface of the flange 671 slidingly engages the upper surface 14*a* of the top wall 14. The interaction between the flange 671 and the top wall 14 provides moveable support for the element 650 such that the element 650 is rotatable between the first position P1 and the second position P2. Thus, the flange 671 provides means for supporting the element 650 within the internal cavity 38 of the cover 612 whereby the element 650 is rotatable between the first and second positions P1, P2.

As shown in FIGS. 17 and 18, the flange 671 is positioned about the end walls 674 and the side walls 674, but below the top wall 676 of the post 654. Also, the flange 671 extends from the periphery of the post 654 such that the post 654 has a "T-shaped" configuration. Preferably, the flange 671 is integrally formed with the post 654 and is flexible. As a result, when the post 654 is inserted into the slot 30 during the assembly process, the flange 671 flexes as it passes through the slot 30 and then returns to its original configuration (meaning un-flexed) when it clears the slot 30. The flange 671 defines a plane that is in planar alignment with a plane defined by the top wall 14 of the cover 612. Alternatively, the flange 671 is angled, peaked, or sloped. The flange 671 has a length and a width, wherein each is greater than a length and width of the the post 654. Preferably, the width of the flange 671 corresponds with the width of the top wall 14 of the cover 612. One of ordinary skill recognizes that the dimensions of the flange 671 can not be so great as to preclude the passage of the flange 671 through the slot 30.

The lid 610 is shown as having the flange 671 and no support members 34. However, the lid 610 can have a combination of these structures. For example, the lid 610 could include the flange 671 and at least one support member 34 and the resulting support ledge 100. In this configuration, the element 650 is rotatably supported by the interaction between the flange 671 and the top wall 14 and by the interaction between the peripheral edge 51 of the element and the support ledge 100. As another example, the lid 610 could have two or more posts 654 and a corresponding number of slots 30, wherein each post 654 has a flange 671 that slidably engages the top wall 14 of the cover 612 near each respective slot 30. In this manner, the element 650 is rotatably supported by the interaction between multiple flanges 671 and the top wall 14.

FIGS. 19–22 disclose an alternate embodiment of a lid of the present invention generally designated with the reference numeral 710. The lid 710 generally has a cover 712 and the rotatable element 750, and the similar elements thereof retain their reference numerals. The cover 712 has a side wall 716 with a vertical channel or rib 717. The vertical channel 717 is internal to the cover 712, however, the channel 717 protrudes from the outer surface 716*a* of the side wall 716. This means that the side wall 716 is raised at the channel 717. The channel 717 extends between the lower edge 20 of the side wall 716 and the peripheral edge 18 of the top wall 714. This means that the channel 717 is positioned between the mounting portion 22 and the top wall 714. The channel 717 is adapted to provide a first passageway for the flow of the flowable contents through the lid 710. In this manner, the channel 717 provides a generally vertical passageway for the content to flow to the opening 28 of the lid 710.

Referring to FIG. 22, the rotatable element 750 has a first projection 752 and a second projection 753. The projections 752, 753 are spaced a distance apart but remain within the recessed portion 784 of the element 750. Since the portion 784 is recessed or depressed with respect to the top wall 756 of the element 750, the element 750 has transition walls 785 between the top wall 756 and the recessed portion 784. Furthermore, the recessed portion 784 defines a plane that is below a plane defined by the top wall 756. Unlike recessed portions discussed above, the recessed portion 784 has increased dimensions such that the recessed portion 784 extends to the peripheral edge 751 of the element 750. Described in a different manner, the recessed portion 784 has an extended portion 784*a* that is coincident with the peripheral edge 751. As a result, an extent of the outer shoulder 758 and the side wall 759 proximate the extended portion 784 are omitted. Due to the configuration of the recessed portion 784, the aperture 78 is omitted. The recessed portion 784 is adapted to provide a second passageway for the flow of the flowable contents through the lid 710. The rotatable element 750 has an opening 763 and a plurality of wells 790 positioned radially outward of the opening 763. The recessed portion 784 is shown as spanning a pair of wells 790, however, the dimensions of the portion 784 can vary with the design parameters of the lid 710.

The lid 710 is movable between a closed or first position P1 and an open or second position P2. In the first position P1 shown in FIGS. 19 and 21A, the first projection 752 is received by the drink opening 28 of the cover 712. The second projection 753 is positioned beneath the top wall 714 but preferably beyond the lip recess 40 of the cover 712. Also, the channel 717 is positioned between the first and second projection 752, 753. Furthermore, the post 54 of the rotatable element 750 extends through the slot 30 of the cover 712. Although the vertical channel 717 creates a fluid passageway, the first projection 752 obstructs fluid flow through the drink opening 28 of the cover 712.

Consistent with that explained above, the post 54 is actuated to move the lid 710 between the first and second positions P1, P2. In the open or second position P2 shown in FIG. 21B, both the first projection 752 and the second projection 753 are misaligned with the drink opening 28. Described in a different manner, the first and second projections 752, 753 are positioned about the opening 28. Referring to FIG. 21B, the first projection 752 is shown as being positioned beyond the opening 28, while the second projection 753 is not shown due to the section line used to section FIG. 19. In the second position P2, the recessed portion 784 of the element 750 is in fluid communication with the channel 717. Specifically, the extended portion 784*a* of the recessed portion 784 is in fluid communication with the channel 717. In the second position P2, the second projection 753 is positioned between the drink opening 28 and the channel 717. In the second position P2, the interaction between the cover 712 and the projections 752, 753 exerts a downwardly directed force on the element. 750 which deflects the element 750. This deflection of the element 750 creates a clearance C between the inner surface of the cover 712 and the rotatable element 750. Specifically, the interaction between the first projection 752 and/or second projection 753 and an inner surface of the top wall 40*c* of the recessed portion 40 causes the element 740 to deflect or flex which results in the clearance C near the drink opening 28 of the cover 712. The clearance C is a function of the deflection of the rotatable element 750. Preferably, the region of deflection of the element 750 is the recessed portion 784. The top wall 40*c* of the recessed portion is positioned below the top wall 714 of the cover 712 which is evidenced by the notch or step between the top wall 40*c* and the top wall 714. The clearance is further defined by the extended portion 784*a* of the recessed portion 784 of the rotatable element 750. The clearance C completes the fluid passageway that allows the container contents to flow through the drink opening 28. Accordingly, the fluid passageway is formed by the vertical channel 717 and the clearance C between the rotatable element 750 and top wall 40*c* about the drink opening 28. The clearance C is maintained while the rotatable element 750 is rotatably supported by the support members 102 of the cover 712. The top walls 714, 40*c* are dimensioned such that the first projection 752 and/or the second projection 753 can slidingly engage the inner surface thereof to permit movement between the first and second positions P1, P2.

Figure 23:
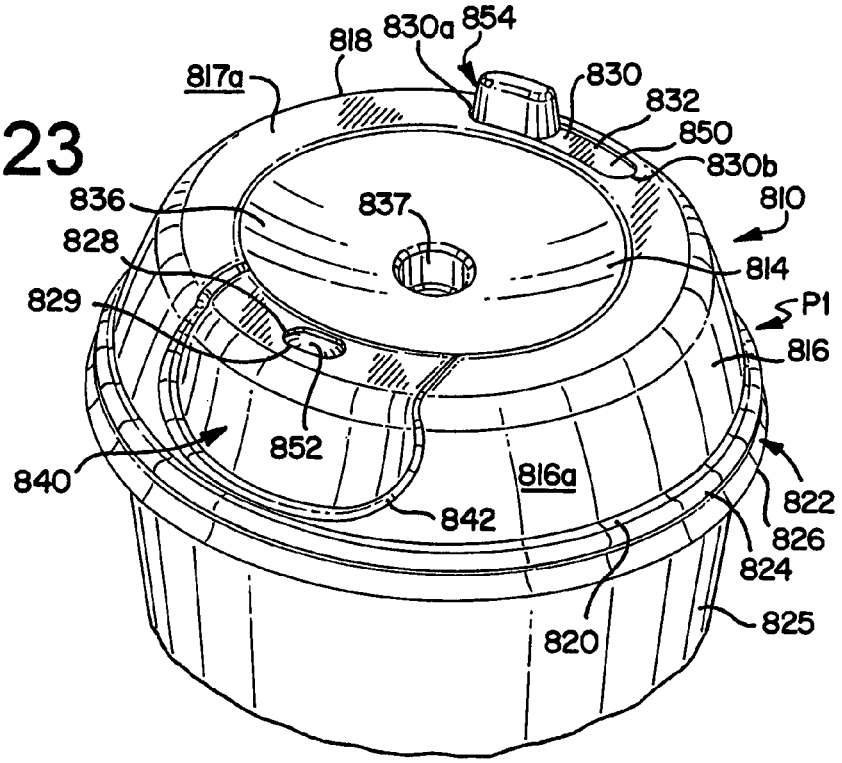
FIG. 23 is a perspective view of an alternate embodiment of the lid of the present invention, the lid shown in a closed position.
Figure 24:
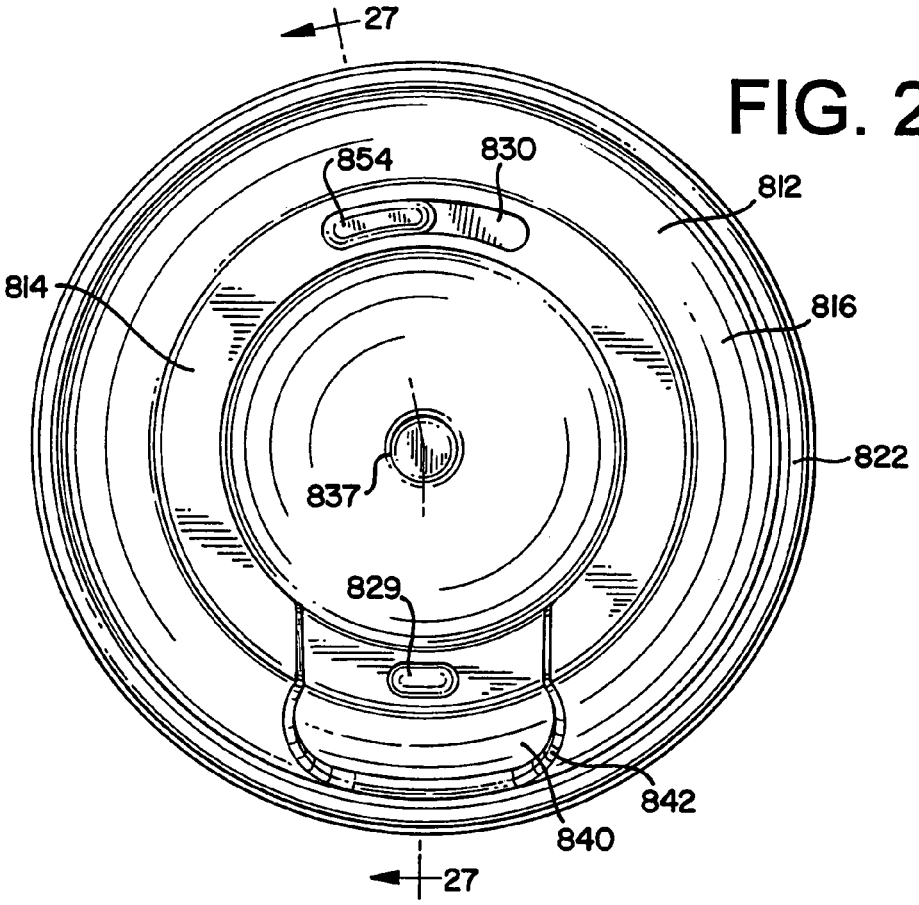
FIG. 24 is a top view of the lid of FIG. 23, the lid shown in a closed position.
Figure 26:
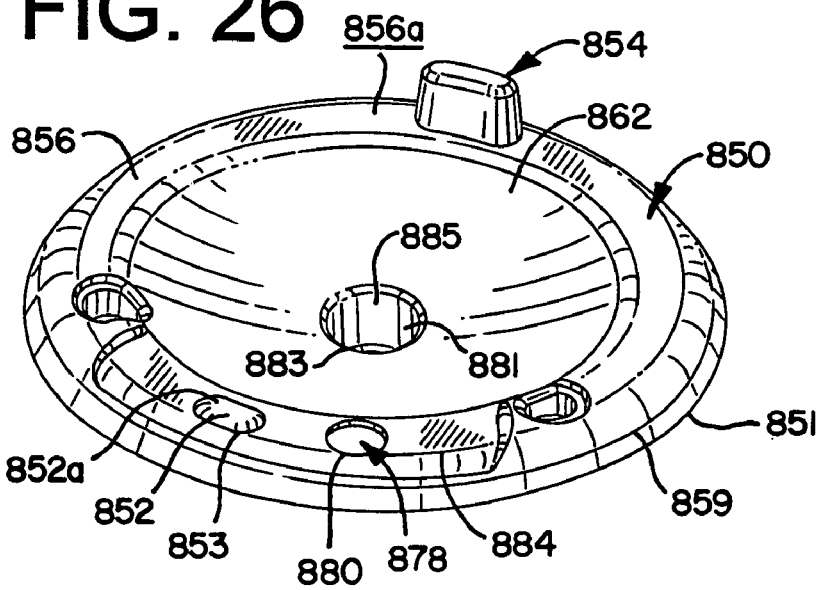
FIG. 26 is a perspective view of a moveable element of the lid of FIG. 23.
Figure 27:
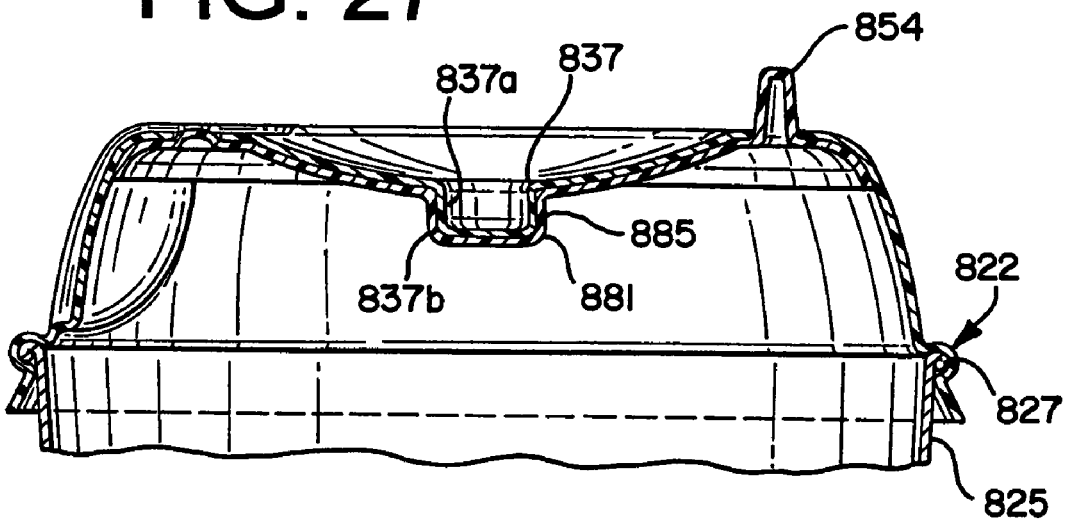
FIG. 27 is a cross-sectional view of the lid of FIG. 23, taken along lines 27—27 of FIG. 24; and, FIG. 28 is a perspective view of the lid of FIG. 23, the lid shown in an open position.
Figure 28:
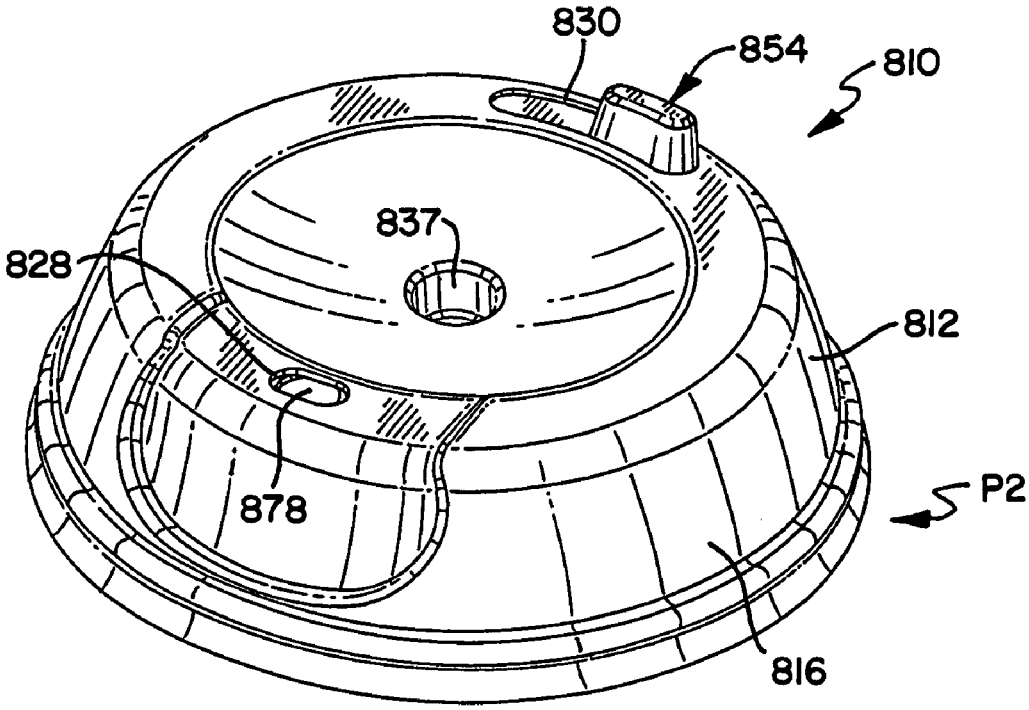

FIGS. 23–28 disclose another embodiment of the reclosable lid of the present invention, generally designated with the reference numeral 810. Like the previous embodiments, the lid 810 is adapted to be attached to a container 825. The container 825 has a central opening defining a volume that can be used to hold or contain a flowable substance, for example a liquid. The container 825 and the lid 810 can be of either the disposable or extended use variety. FIGS. 23 and 24 show the lid 810 in a closed position P1 wherein the lid 810 is sealed such that the flowable substance cannot flow through the lid 810. FIG. 28 shows the lid 810 in an open position P2, wherein a flowable substance may flow from the container 825 and through the lid 810. The lid 810 generally comprises a cover 812 and a moveable or rotatable element 850.

Figure 25:
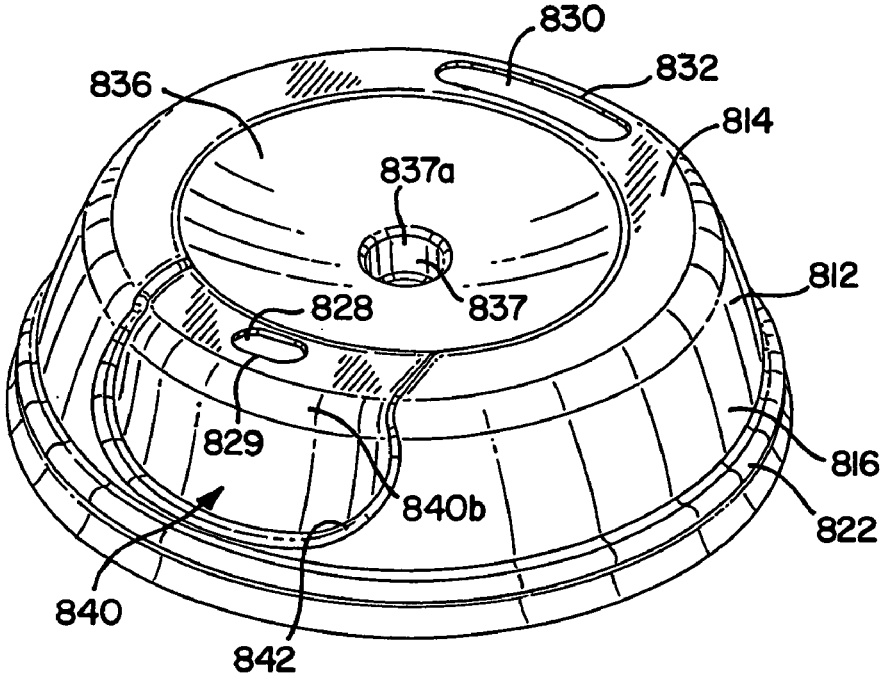
FIG. 25 is a perspective view of a cover of the lid of FIG. 23.

The cover 812 is adapted to be attached to the container 825 that holds a flowable substance. The cover 812 is adapted to span the opening in the upper portion of the container 825 that is generally defined by an upper rim or edge 827 of the container 825. For illustrative purposes, the container 825 could be a coffee cup having an opening defined by the rim of the cup. The cover 812, as illustrated in FIGS. 23–25, generally has a top wall 814, a side wall 816, and a mounting portion 822 adapted to be attached to the container 825.

The top wall 814 is generally annular, although other configurations are possible. The side wall 816 depends from a peripheral edge 818 of the top wall 814. Although the top wall 814 is shown as having a generally level upper surface 814*a*, the upper surface 814*a* can be curved or angled. The side wall 816 has a side wall surface 816*a* and a lower edge 820. The side wall surface 816*a* can be curved or generally flat. The overall shape of the cover 812 is generally frustaconical, however, the cover 812 can have a number of other configurations.

A mounting portion 822 depends from the lower edge 820 of the side wall 816, and can be considered as part of the side wall 816. The mounting portion 822 includes a generally annular flange 824 and a generally annular skirt 826. The mounting portion 822 is adapted for connecting the lid 810 to the container 825 in a manner that seals the lid on the container 825. Thus, the mounting portion 822 prevents leakage of the container 825 contents between the lid 810 and the container 825 when the lid 810 is positioned on the container 825. In a preferred embodiment, the mounting portion 822 is integral with the side wall 816.

A drink opening 828 is located preferably in the top wall 814. Alternatively, the opening 828 is located in the side wall 816. The opening 828 is adapted to permit the passage or flow of the flowable contents held by the container 825 through the cover 810. The opening 828 has an edge 829 that defines the shape of the opening 828. Although shown in FIGS. 23–25 as having an obround shape, the opening 828 can have a variety of shapes, including but not limited to circular, square, or rectangular.

A slot or channel 830 is located preferably in the top wall 814. Alternatively, the slot 830 may be located in the side wall 830. The slot 830 permits access to the actuator 854 used for rotating the moveable element 850 as described in greater detail below. The slot 830 has an edge 832 that defines the shape of the slot 830. Although shown in FIGS. 23–25 as having an obround shape, the slot 830 can have a variety of shapes, including but not limited to circular, square, or rectangular. Because the slot 830 must provide access to the actuator 854, the shape and size of the slot 830 will be related to the form and size of the actuator 854. As previously described, in an alternate embodiment, the moveable element 850 can have two apertures. While most features of the cover 810 need not be changed to adapt to a double-aperture element, the slot 830 may need to be enlarged to accommodate the larger range of motion required to move between additional positions.

As further shown in FIGS. 23, 25 and 27, the cover 810 has a support member 837, which preferably depends from a central portion 836 of the top wall 814. In a most preferred embodiment, the support member 837 depends from a center of the top wall 814. The support member 837 is adapted such that the rotatable element 850 may be rotatably mounted on the support member 837. The support member 837 is generally a cylindrical protrusion in the underside of the top wall 814, and has an inner side wall 837*a* and an outer side wall 837*b*. Alternatively, the support member 837 may be embodied in one of many other shapes and forms. For example, the support member 837 may contain or comprise a lip or cusp (not shown) for securing the disk. Furthermore, although in the preferred embodiment, the support member 837 is located substantially in the center of the top wall 814, it need not be located in the center, nor even in the top wall 814. Additionally, the support member 837 need not depend from the top wall 814, and may comprise any form on which the element 850 may be rotatably mounted, for example a depression on the underside of the top wall 814 (which may form a projection from the upper side of the top wall) or an aperture through the top wall 814. Preferably, the support member 837 is integral with the top wall 814, but a separable support member would function suitably. In addition, the support member 837 may comprise a separate rivet member. The support member 837 could also comprise a generally arrowhead-shaped member that cooperates with an opening in the moveable element 850. The support member 837 could also form part of a ball and socket arrangement with the moveable element 850 to rotatably support the element 850. It is further understood that in a preferred embodiment, the element 850 is rotatably supported on an underside of the cover 812. It is appreciated, however, that the element 850 could be supported on a top surface of the cover 812 to provide the reclosable lid of the present invention.

As shown in FIG. 23, the top wall 814 has a center portion 836 which is preferably recessed such that the center portion 836 has a curvilinear configuration when viewed in cross-section. The degree of recess or curvature of the center portion 836 can vary with the design parameters of the lid. Alternatively, the entire top wall 814 is in planar alignment. In this configuration, the center portion 836 is not recessed.

Referring to FIGS. 23 and 24, the side wall 816 has a recessed portion 840, which is adapted to receive a lip of a person drinking from the container. An edge 842 of the recessed portion 840 defines the configuration of the portion. The recessed portion 840 is positioned radially inward from the side wall surface 816*a*. Although the recessed portion 840 is shown positioned on both the top wall 814 and the side wall 816, the recessed portion 840 can be limited to either the top wall 814 or the side wall 816. The shape and configuration of the recessed portion 840 can be varied to conform to numerous design parameters. Similarly, the degree of recess of the portion 840 can vary. For example, as shown in FIG. 1, the recessed portion 840 is deeper at a base portion and shallower at an end proximate the drink opening 828. Preferably, the recessed portion 840 is positioned about the drink opening 828. The top wall 814 and the side wall 816 cooperate to form a rounded edge or shoulder 840*b* at the recessed portion 840. It is further understood that the cover 812 of the lid 810 could also have a tab formed thereon as shown in the embodiment of FIG. 9.

The moveable element, or disk, 850 is illustrated in FIGS. 23 and 26. The element 850 is rotatably mounted on the support member 837 of the cover 812 such that the support member 837 is received in a portion of the element 850. As discussed above, several structures have been disclosed and other structures are possible wherein the element 850 is rotatably supported with respect to the cover 812. In addition, although the moveable element 850 is illustrated as a disk, and is referred to interchangeably as a "disk" throughout this description, this is only illustrative of the preferred embodiment. The moveable element 850 may take any of a multitude of forms other than a disk, and the shape of the movable element 850 is not a limitation of the present invention. For example, the disk can be ring-shaped as described above in other embodiments of the invention.

As shown in FIG. 26, the element 850 has an aperture 878, an actuator 854 accessible through the slot 830, a projection 852, and an indentation or depression 881. The element 850 has an outer edge 851 and a top wall 856 with an top wall surface 856*a* and a center portion 862. A side wall 859 depends from the top wall 856. The top wall 856 has a center portion 862 extending radially inward from the top wall surface 856*a*. Preferably, the center portion 862 is recessed such that the center portion 862 has a curvilinear configuration when viewed in cross-section. The degree of recess or curvature of the center portion 862 can vary with the design parameters of the lid 810. Preferably, the degree of recess of the center portion 862 of the element 850 is similar to the degree of recess of the center portion 836 of the cover 812. Alternatively, if the entire top wall 814 of the cover 812 is in planar alignment, the top wall surface 814*a* and the center portion 862 of the element 850 are also in planar alignment.

The projection 852 extends from a portion of the top wall 856. The projection 852 has a peripheral edge 853 that defines the shape of the projection 852. Preferably, the projection 852 is cooperatively dimensioned with the drink opening 828 such that at least a portion of the projection 852 is adapted to be received by, or positioned in, the opening 828. The projection 852 has a projection surface 852*a* that is preferably sloped or angled to facilitate reception of the projection 852 by the opening 828. When the projection 852 is completely received in the opening 828, the opening 828 is sealed and the lid 810 is in the closed position shown in FIG. 23. Although the presence of the projection 852 is preferable, it is not essential to the present invention. Alternatively, the element 850 has a generally planar surface that is aligned with a surface of the cover 812 proximate the opening 828 in a surface-to-surface engagement such that the opening 828 is sealed. Such as shown in the above embodiments, the element 850 can have a opening adapted to drain the flowable contents into the container 825.

The actuator 854 is accessible through the slot 830 in the cover 812, and is manipulated to move the element 850 between an open position P2 and a closed position P1. As illustrated in FIG. 26, the actuator 854 is preferably a post, but may take any other form suitable for manipulation. For example, the actuator 854 could be a small projection or protuberance; a series of smaller projections, bumps, or ridges; or simply a high-friction surface. The post 854 of the preferred embodiment extends from a portion of the top wall 856. In an alternative embodiment, the post or actuator 854 may be positioned on the side wall 859 of the element 850, and the slot 830 may be correspondingly positioned on the side wall 816 of the cover 812. The post 854 can have either a solid or hollow construction depending upon design parameters. At least a portion of the post 854 is received by the slot 830 and extends past the top wall surface 814*a*. Although the configuration and dimensions of the post 854 can vary according to design parameters of the lid 810, the post 854 must retain a configuration that permits it to-be accessible through the slot 830. As shown in FIG. 26, the post 854 has a catenoid shape. The post 854 can have a gripping portion (not shown) that is adapted to facilitate the engagement of a user's fingers with the post 854. The gripping portion can be integral to the post 854 or it can be a separate element fastened to a portion of the post 854. For example, the gripping portion can be a plastic or rubber element fastened to the walls of the post 854.

As shown in FIG. 26, the disk 850 has at least one aperture 878. The aperture 878 has a peripheral edge 880 that defines the shape of the aperture 878. When the aperture 878 is aligned with the drink opening 828, a passageway is formed between the element 850 and the cover 812 permitting the passage or flow of the flowable substance held by the container 825 through the lid 810. Although the aperture 878 can have a variety of configurations and dimensions, the aperture 878 is preferably cooperatively dimensioned with the drink opening 828. In a preferred embodiment, the aperture 878 is positioned on the disk top wall 856 and spaced a distance from the projection 852. In another preferred embodiment, similar to the embodiment described in FIGS. 15–16, the element 850 could include two separate apertures, each spaced a distance from the projection 852. The aperture 878 may be positioned on the disk side wall 859 if necessary, such as if the drink opening 828 of the cover 812 is positioned on the cover side wall 816. The aperture 878 could be formed merely by forming a slot or channel in the peripheral edge 851 of the element 850.

A disk recessed portion 884 is preferably positioned about the projection 852 and the aperture 878. The degree of recess of the portion 884 can vary. Although the recessed portion 884 is shown positioned on a portion of both the disk side wall 859 and the disk top wall 856, the recessed portion 884 can be limited to either the side wall 859 or the top wall 856. The recessed portion 884 is adapted to be received by an inner surface of the recessed portion 840 of the cover 812 when the element 850 is positioned proximate the cover 812. The position of the recessed portion 884 of the element 850 is similar to the position of the recessed portion 840 of the cover 812.

An indentation 881 is located in the center 862 of the disk top wall 856, and is one preferred mechanism for rotatably mounting the disk 850 on the support member 837. As discussed, several structures can be used to rotatably support the element 850 on the cover 812. The indentation 881 illustrated in FIG. 26 is cylindrical in shape, and has an indentation edge 883 and an inner side wall 885. Alternatively, the indentation 881 may have a more complex shape, or may simply comprise an aperture. The support member 837 and the indentation 881 are cooperatively dimensioned such that they are in rotational engagement with each other. Preferably, the support member 837 and the indentation 881 engage each other with an interference fit between the inner side wall 883 of the indentation 881 and the outer side wall 837*b* of the support member 837, as illustrated in FIG. 27.

Referring to FIG. 23, the element 850 and the cover 812 are cooperatively dimensioned such that the element 850 can be positioned within the interior region defined by the cover 812, to comprise an "assembled position," wherein the element 850 is rotatably mounted on the support member 837. As further shown in FIGS. 23, 27 and 28, the element 850 is attached to the support member 837 in such a way that the element 850 is held in place, while having at least some freedom to rotate in either direction. Preferably, as described above, the support member 837 and the indentation 881 are cylindrically shaped and engage each other with an interference fit. Other structures could be added to the support member 837 and indentation 881 to enhance the rotatable connection. However, many other mechanisms for rotatably mounting the element 850 upon the support member 837 exist, and the present invention is not intended to be limited to any particular mechanism for rotational engagement between the element 850 and the cover 812. In one alternative embodiment, the support member 837 contains or comprises a lip or cusp for holding the disk in place, eliminating the necessity for an interference fit. In another possible embodiment, the support member 837 consists of only an aperture, and the disk contains a cooperatively dimensioned projection that extends through the aperture to support the disk, rather than an indentation. Furthermore, it is understood that the male/female aspects of the support member 837 and indentation 881 could be reversed on the cover 812 and element 850. The key aspect of the present invention is not the structure of the mounting mechanism, but the use of a moveable element rotatably mounted by a support member.

In the assembled position, the actuator 854 is accessible by a user through the slot 830. In the preferred embodiment, the element 850 is positioned proximate the cover 812 such that at least a portion of the post 854 is received by and extends through the slot 830. In this configuration, the element 850 is positioned beneath the cover 812 such that the center portion 836 of the cover 812 is proximate the center portion 862 of the element 850. The actuator 854 may take one of many other forms, but regardless of the form of the actuator, it is accessible through the slot 830.

In the assembled position, the element 850 is movable by rotating between a first, or closed, position and a second, or open, position. The element 850 is moved between the first and second positions P1, P2 by manipulation of the actuator 854 by a user. In the first position P1, as shown in FIG. 23, the projection 852 is received by the drink opening 828 such that the opening 828 is sealed and the lid 810 is closed. When the opening 828 is sealed, the edge 829 of the opening 828 is in frictional engagement with the projection 852. The top portion of the projection 852 can extend past the edge 829 of the drink opening 828. This seal prevents the flow of the flowable substance in the container 825 through the opening 828, enabling the container 825 and lid 810 to be moved without risking spillage. Also, in the first position P1, the recessed portion 862 of the element 850 is engaged with the recessed portion 836 of the cover 812. In addition, in the first position P1, the aperture 878 is misaligned or offset from the opening 828. Alternatively, the projection 852 and the opening 828 are in a snap fit engagement wherein each have sufficient structure to enable the snap fit engagement. Other cooperating structures can also be utilized.

In an alternate configuration of the element 850, the projection 852 is omitted (not shown), and the top wall surface 856 is substantially flat. In the first position P1, the flat top wall 856 surface of the element 850 is aligned with the opening 828 in a surface-to-surface engagement such that the opening 828 is sealed.

In the second position P2, the aperture 878 is aligned with the drink opening 828 to form a passageway between the element 850 and the cover 812 wherein the lid 810 is open, as illustrated in FIG. 28. The passageway permits the passage or flow of the flowable substance held by the container 825 through the lid 810. When the lid 810 is in the second position P2, at least a portion of the aperture 878 is aligned with at least a portion of the edge 829 of the drink opening 828. In addition, in the second position P2, the projection 852 is misaligned with, or offset from, the opening 828. When the aperture 878 is partially aligned with the drink opening 828, the passageway remains but its dimensions are reduced. When the aperture 878 is completely misaligned with the drink opening 828, the passageway is eliminated. When the aperture 878 is completely misaligned with the drink opening 828 and the projection 852 is received in the opening 828, the opening 828 is sealed and the lid 810 is in the first position, P1. Alternatively, if no projection is present, the element 850 is returned to the first position P1 wherein the aperture 878 is completely misaligned with the drink opening 828, and the opening 828 is sealed.

A user can move the element 850 between the first position P1 and the second position P2 by manipulating the actuator 854. In the preferred embodiment, this is done by grasping and actuating or manipulating the post 854 between the first end 830*a* of the slot 830 and the second end 830*b* of the slot 830. Referring to FIG. 23, when the post 854 is proximate the first end 830*a*, the element 850 is in the first position P1. Conversely, referring to FIG. 28, when the post 854 is proximate the second end 830*b*, the element 850 is in the second position P2. The post 854 can be located in a number of positions between the first and second ends, and as a result, the projection, 852 can be misaligned with the opening to varying degrees.

As explained above, the element 850 can have a first and second aperture, wherein the apertures are positioned about the projection such as shown by the disk in FIG. 16. In this configuration, the disk can be rotated in either a clockwise or counter-clockwise direction to move the disk between a first position, in which the lid is closed, and a second position and a third position, in which the lid is open. In this position, the actuator is located close to the center of the slot, rather than at either end. When the disk is in the first position, rotating the disk in the clockwise direction brings the first aperture into alignment with the opening. Similarly, when the disk is in the first position, rotating the disk in the counter-clockwise direction moves the disk to the third position, bringing the second aperture into alignment with the opening. This feature further increases the flexibility and value of the lid.

The lids of the present invention provide several benefits. The lid provides a means by which to allow a consumer to seal the contents of the beverage inside the container to prevent leakage, spillage, contamination, and heat loss or gain, while retaining the ability to quickly and easily reopen the container for beverage consumption. The lid of the present invention has a construction providing for simple and effective operation and is easy to assemble. The lid can be easily mass-produced and is disposable and recyclable.

Finally, several preferred embodiments of the lid of the present invention have been described herein. It is understood that the different features of the several different embodiments can be utilized in various combinations as desired.

The dimensions of the lids 10, 210, 310, 510, 610, 710, 810 can vary with design parameters. For example, the outer diameter of the aforementioned lids as measured from opposed points in the mounting portion can vary. As another example, the overall height of the lids as measured from the lower edge of the mounting portion to the top wall can vary. One of ordinary skill recognizes that the dimensions can be adjusted without departing from the spirit of the invention.

While specific embodiments have been illustrated and described, numerous modifications come to mind without significantly departing from the spirit of the invention and the scope of protection is only limited by the scope of the accompanying Claims.

What is claimed is:

1. A lid for a container holding a flowable substance, the lid comprising:

a cover adapted to be attached to the container, the cover having an uppermost top wall with both an opening and a slot, the cover further having a sidewall depending downward from an outer edge of the top wall, and a mounting portion extending outward from a lower edge of the sidewall, the cover further having a tab extending outward from the cover; and an element rotatably supported by the cover, the element having an aperture and an actuator accessible through the slot, wherein the element is moveable by manipulation of the actuator between a first position wherein the aperture is misaligned with the opening, and a second position wherein the aperture is aligned with the opening.

2. The lid of claim 1 wherein the cover has an annular top wall and the opening is positioned in the top wall.

3. The lid of claim 2 wherein the slot is positioned in the annular top wall.

4. The lid of claim 1 wherein the tab extends radially outward from the mounting portion.

5. The lid of claim 4 wherein the tab has a first segment, a sloped second segment, and a third segment.

6. The lid of claim 4 wherein the tab has a curvilinear peripheral edge.

7. The lid of claim 1 wherein the cover has at least one support member extending radially inward from an inner surface of the cover, wherein the support member rotatably supports the element.

8. The lid of claim 7 wherein the support member is positioned proximate the opening of the cover.

9. The lid of claim 7 wherein the cover has a side wall with a recessed portion, the support member extends from the recessed portion near the opening of the cover.

10. The lid of claim 1 wherein the element has a projection that is received by the opening in the first position.

11. The lid of claim 1 wherein the aperture and the opening are cooperatively dimensioned such that a passageway is formed in the second position, the passageway permitting the flow of the substance through the lid.

12. The lid of claim 1 wherein the element has a projection, and wherein the projection is received by the opening in the first position and offset from the opening in the second position.

13. The lid of claim 1 wherein the actuator is a post that extends from the element and a portion of the post is received in the slot.

14. The lid of claim 1 wherein the element has a disk-shaped configuration.

15. The lid of claim 1 wherein the element has a ring-shaped configuration.

16. A method for assembling a lid for a container holding a flowable substance, the method comprising the following steps:

providing a cover configured to be attached to the container, the cover having an opening and a slot;

providing a rotatable element having an aperture and an upwardly extending actuator;

positioning the cover against at least one external guide to fix the angular position of the cover; and, moving the rotatable element along a substantially vertical path and towards a lower interior region of the cover such that the actuator enters the slot.

17. A method for assembling a lid for a container holding a flowable substance, the method comprising the following steps:

providing a cover configured to be attached to the container, the cover having an opening and a slot, the cover further having a tab extending outward from the cover;

providing a rotatable element having an aperture and an upwardly extending actuator;

positioning the tab of the cover between a pair of external guides to fix the angular position of the cover; and, moving the rotatable element along a substantially linear path and into an interior region of the cover such that the actuator extends through the slot.

18. A method for assembling a lid for a container holding a flowable substance, the method comprising the following steps:

providing a cover configured to be attached to the container, the cover having an opening, a slot, and at least one support member, the cover further having a tab extending outward from the cover;

providing a rotatable element having an aperture and an upwardly extending actuator;

positioning the tab of the cover between a pair of external guides to fix the angular position of the slot; and, moving the rotatable element along a substantially linear path and into an interior region of the cover such that the actuator extends through the slot and the element is rotatably supported by the support member of the cover.

19. A lid for a container holding a flowable substance, the lid comprising:

a cover adapted to be attached to the container, the cover having a slot and an uppermost top wall with an opening, an outer periphery defining an outer edge and a substantially circular inner periphery, the cover further having a sidewall depending downward from the outer edge of the top wall, and a mounting portion extending outward from a lower edge of the sidewall to define an outermost periphery of the cover;

an element having a circular outer periphery, an aperture and an actuator accessible through the slot, wherein the element is moveable by manipulation of the actuator between a first position wherein the aperture is misaligned with the opening, and a second position wherein the aperture is aligned with the opening; and the cover having means for rotatably supporting the element to permit movement between the first and second positions.

20. A lid for a container holding a flowable substance, the lid comprising:

a cover having a mounting portion for attachment of the cover to the container, the cover further having a sidewall extending vertically upward from the mounting portion and an uppermost top wall with an opening, the cover further having a slot, the mounting portion having an outwardly extending tab; and an element rotatably supported by the cover, the element having an aperture and an actuator accessible through the slot, wherein the element is moveable by manipulation of the actuator between a first position wherein the aperture is misaligned with the opening, and a second position wherein the aperture is aligned with the opening.

21. The lid of claim 20 wherein the slot is located in the uppermost top wall.

22. A lid for a container holding a flowable substance, the lid comprising:

a cover adapted to be attached to the container, the cover having an uppermost top wall with an opening, the cover further having a slot and an outwardly extending tab, and at least one support member extending radially inward from an inner surface of the cover; and, an element rotatably supported by the support member, the element having an aperture and an actuator accessible through the slot, wherein the element is moveable by manipulation of the actuator between a first position wherein the aperture is misaligned with the opening, and a second position wherein the aperture is aligned with the opening.

23. The lid of claim 22 wherein the cover has a mounting portion for connection of the cover to the container, the tab extending outward from the mounting portion.

24. The lid of claim 22 wherein the slot is located in the top wall.

25. The lid of claim 19, wherein the rotatable supporting means extends inward from a wall of the cover.

26. The lid of claim 19, wherein the rotatable supporting means extends inward from the sidewall of the cover.

27. The lid of claim 19, wherein the rotatable supporting means comprises a ledge formed on an inner surface of the sidewall.

28. The lid of claim 19, wherein the rotatable supporting means comprises a plurality of circumferentially spaced ledges formed on an inner surface of the sidewall.

* * * * *